US011109683B2

(12) United States Patent
Deevers et al.

(10) Patent No.: US 11,109,683 B2
(45) Date of Patent: Sep. 7, 2021

(54) BODY SUPPORT ASSEMBLY AND METHOD FOR THE USE AND ASSEMBLY THEREOF

(71) Applicant: Steelcase Inc., Grand Rapids, MI (US)

(72) Inventors: Nickolaus William Charles Deevers, Holland, MI (US); Kurt R. Heidmann, Grand Rapids, MI (US); Gordon J. Peterson, Rockford, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 16/794,946

(22) Filed: Feb. 19, 2020

(65) Prior Publication Data

US 2020/0288871 A1 Sep. 17, 2020

Related U.S. Application Data

(60) Provisional application No. 62/808,579, filed on Feb. 21, 2019, provisional application No. 62/947,914, filed on Dec. 13, 2019.

(51) Int. Cl.

| | |
|---|---|
| ***A47C 3/026*** | (2006.01) |
| ***A47C 7/02*** | (2006.01) |
| ***A47C 7/14*** | (2006.01) |
| ***A47C 7/28*** | (2006.01) |

(52) U.S. Cl.

CPC ..... *A47C 7/282* (2013.01); *A47C 7/029* (2018.08)

(58) Field of Classification Search

CPC ..... A47C 7/029; A47C 7/282
USPC ..... 297/296, 297, 300.1–309, 452.55
See application file for complete search history.

(56) References Cited

U.S. PATENT DOCUMENTS

| | | | |
|---|---|---|---|
| 136,531 | A | 3/1873 | Mitchell |
| 171,356 | A | 12/1875 | Cushman et al. |
| 217,169 | A | 7/1879 | Taylor |
| 248,342 | A | 10/1881 | Patchin et al. |
| 258,338 | A | 5/1882 | Wooldridge |
| 363,723 | A | 5/1887 | Brown |
| 409,389 | A | 8/1889 | Campbell |
| 447,854 | A | 3/1891 | Webster |
| 480,822 | A | 8/1892 | Mayes |
| 827,693 | A | 7/1906 | Korb |
| 1,597,355 | A | 8/1926 | Fussell |
| 1,789,337 | A | 1/1931 | Knabusch et al. |
| 1,886,308 | A | 11/1932 | Schultes |
| 2,028,633 | A | 1/1936 | Thomas |
| 2,083,838 | A | 6/1937 | Goenen |
| 2,087,254 | A | 7/1937 | Herold |
| 2,271,925 | A | 2/1942 | Niles |
| 2,321,385 | A | 6/1943 | Herold |

(Continued)

FOREIGN PATENT DOCUMENTS

| | | | |
|---|---|---|---|
| AT | 505212 | A1 | 11/2008 |
| BE | 519252 | A | 5/1953 |

(Continued)

OTHER PUBLICATIONS

US 10,932,573 B2, 03/2021, Masunaga et al. (withdrawn)

(Continued)

*Primary Examiner* — Rodney B White
(74) *Attorney, Agent, or Firm* — Crowell & Moring LLP

(57) ABSTRACT

A body support assembly includes a seat assembly and backrest assembly supported by tilt control assembly. Methods of using and assembling the body support assembly are provided.

21 Claims, 22 Drawing Sheets

(56) References Cited

U.S. PATENT DOCUMENTS 2,343,739 A 3/1944 Bernstein
2,347,859 A 5/1944 Williams
2,355,635 A 8/1944 Dubilier
2,414,978 A 1/1947 Richardson
2,487,502 A 11/1949 Willinsky
2,540,823 A 2/1951 Heller
2,560,925 A 7/1951 Brown
2,579,502 A 12/1951 Lorenz
2,613,731 A 10/1952 Roginski
2,615,496 A 10/1952 Lorenz et al.
2,616,484 A 11/1952 Christie
2,746,520 A 5/1956 Ducrot
2,818,911 A 1/1958 Syak
2,830,650 A 4/1958 Lorenz
D183,440 S 8/1958 Williams
D192,165 S 2/1962 Brandon
3,041,109 A 6/1962 Eames et al.
3,059,971 A 10/1962 Becker
3,117,819 A 1/1964 Kudriavetz
3,121,590 A 2/1964 Schliephacke
3,120,407 A 4/1964 Propst
D200,640 S 3/1965 Yamasaki
3,271,072 A 9/1966 Barker
3,284,131 A 11/1966 Fletcher
3,298,742 A 1/1967 Cadiou
3,330,251 A 1/1967 Helms
D207,955 S 6/1967 Rodrigo
3,337,267 A 8/1967 Rogers, Jr.
3,370,885 A 2/1968 Gale
3,423,775 A 1/1969 Cockerill
3,463,547 A 8/1969 Brennan et al.
3,560,048 A 2/1971 Flint
3,565,482 A 2/1971 Blodee
3,576,704 A 4/1971 Groce et al.
3,583,759 A 6/1971 Kramer
3,588,370 A 6/1971 Barecki et al.
3,601,446 A 8/1971 Horby
3,602,537 A 8/1971 Kerstholt et al.
3,606,464 A 9/1971 Arbuthnot
3,643,308 A 2/1972 Yamamoto
3,711,156 A 1/1973 Bloomfield
3,712,666 A 1/1973 Stoll
3,740,792 A 6/1973 Werner
3,741,607 A 6/1973 Cramer
D227,829 S 7/1973 Klose
D228,717 S 10/1973 Kramer
3,815,954 A 6/1974 Rogers et al.
3,827,750 A 8/1974 Fantoni
3,844,612 A 10/1974 Borggren et al.
3,862,454 A 1/1975 Mazzucconi
3,874,727 A 4/1975 Mehbert et al.
3,877,750 A 4/1975 Scholpp
3,880,465 A 4/1975 Scheben
3,930,565 A 1/1976 Scheben et al.
3,948,702 A 4/1976 Theissen
4,009,856 A 3/1977 Wolters et al.
4,036,527 A 7/1977 Faul
4,072,288 A 2/1978 Wirges et al.
4,143,910 A 3/1979 Geffers et al.
4,157,203 A 6/1979 Ambasz
4,161,337 A 7/1979 Ross et al.
4,200,332 A 4/1980 Brauning
D255,183 S 6/1980 Locher
D255,184 S 6/1980 Locher
4,331,360 A 5/1982 Roundybuch et al.
4,370,002 A 1/1983 Koepke
4,373,692 A 2/1983 Knoblauch et al.
4,380,352 A 4/1983 Diffrient
4,388,801 A 6/1983 d'Alquen
4,411,469 A 10/1983 Drabert et al.
4,429,917 A 2/1984 Diffrient
4,432,582 A 2/1984 Wiesmann et al.
4,451,085 A 5/1984 Franck et al.
4,471,994 A 9/1984 Zuend et al.
4,478,454 A 10/1984 Faiks
4,479,679 A 10/1984 Fries et al.
D276,575 S 12/1984 Helmholdt
D276,576 S 12/1984 Helmholdt
4,502,729 A 3/1985 Locher
4,536,029 A 8/1985 Rogers, Jr.
4,537,445 A 8/1985 Neuhoff
4,545,614 A 10/1985 Abu-Isa et al.
4,552,405 A 11/1985 Ohl
4,555,136 A 11/1985 Dranger
4,555,139 A 11/1985 Leib
4,575,150 A 3/1986 Smith
4,577,907 A 3/1986 Talmon et al.
4,585,272 A 4/1986 Ballarini
4,597,566 A 7/1986 Scrivner
4,609,225 A 9/1986 Loucks
4,640,548 A 2/1987 Desanta
D289,120 S 4/1987 Chadwick et al.
4,665,606 A 5/1987 Saito et al.
4,707,026 A 11/1987 Johansson
4,709,962 A 12/1987 Steinmann
4,709,963 A 12/1987 Uecker et al.
4,711,491 A 12/1987 Ginat
4,712,834 A 12/1987 Warrick
RE32,594 E 2/1988 Theissen
4,752,101 A 6/1988 Yurchenco et al.
4,761,033 A 8/1988 Lanuzzi et al.
4,779,925 A 10/1988 Heinzel
4,819,458 A 4/1989 Kavesh et al.
4,826,249 A 5/1989 Bradbury
4,834,453 A 5/1989 Makiol
4,854,641 A 8/1989 Reineman et al.
4,865,284 A 9/1989 Desanta
4,869,554 A 9/1989 Abu-Isa et al.
4,889,384 A 12/1989 Sutzer
4,889,385 A * 12/1989 Chadwick ..... A47C 3/026
297/300.1
4,911,501 A 3/1990 Decker et al.
D307,221 S 4/1990 Mudge
4,962,962 A 10/1990 Machate
4,962,964 A 10/1990 Snodgrass
4,966,411 A 10/1990 Katagiri et al.
4,979,778 A 12/1990 Shields
4,988,145 A 1/1991 Engel
5,013,089 A 5/1991 Abu-Isa et al.
5,029,940 A 7/1991 Golynsky et al.
5,029,942 A 7/1991 Rink
5,046,780 A 9/1991 Decker et al.
5,052,753 A 10/1991 Buchacz
5,071,189 A 12/1991 Kratz
5,080,318 A 1/1992 Takamatsu et al.
5,102,196 A 4/1992 Kaneda et al.
5,195,801 A 3/1993 Franck et al.
5,215,807 A 6/1993 Day et al.
5,224,758 A 7/1993 Takamatsu et al.
RE34,354 E 8/1993 Sondergeld
5,235,826 A 8/1993 Brooks et al.
5,249,839 A 10/1993 Faiks et al.
5,251,958 A 10/1993 Roericht et al.
5,267,777 A 12/1993 Valtri
5,269,777 A 12/1993 Doiron et al.
5,282,285 A 2/1994 de Gelis et al.
5,288,127 A 2/1994 Berg et al.
D345,867 S 4/1994 Narita
5,308,144 A 5/1994 Korn
5,320,410 A 6/1994 Faiks et al.
5,333,368 A 8/1994 Kriener et al.
5,345,120 A 9/1994 Taylor
5,348,372 A 9/1994 Takamatsu et al.
D351,744 S 10/1994 Caruso et al.
5,356,199 A 10/1994 Elzenbeck et al.
5,366,274 A 11/1994 Roericht et al.
5,386,728 A 2/1995 Norton et al.
5,397,165 A 3/1995 Grin et al.
5,405,179 A 4/1995 Jih
D358,514 S 5/1995 Lovegrove
5,417,473 A 5/1995 Bräuning
D360,316 S 7/1995 Hodge et al.
5,447,357 A 9/1995 Dauphin
5,457,968 A 10/1995 McClintock et al.

(56) References Cited

U.S. PATENT DOCUMENTS 5,462,336 A 10/1995 Desanta
5,472,260 A 12/1995 Czapski et al.
5,486,035 A 1/1996 Koepke et al.
5,518,294 A 5/1996 Ligon, Sr. et al.
5,558,171 A 9/1996 McGlothlin et al.
5,558,398 A 9/1996 Santos
D376,982 S 12/1996 Otto
5,582,463 A 12/1996 Lindner et al.
D378,480 S 3/1997 Doerner
5,649,739 A 7/1997 Zapf
5,683,139 A 11/1997 Golynsky et al.
5,704,689 A 1/1998 Kim
5,765,804 A 6/1998 Stumpf et al.
5,769,492 A 6/1998 Jensen
5,774,911 A 7/1998 Stube
5,775,774 A 7/1998 Okano
5,795,026 A 8/1998 Dral et al.
5,810,439 A 9/1998 Roslund, Jr.
5,842,264 A 12/1998 Roossien et al.
5,853,223 A 12/1998 Ritt et al.
5,855,991 A 1/1999 McLarty, III
5,868,467 A 2/1999 Moll
5,871,258 A 2/1999 Battey et al.
5,873,634 A 2/1999 Geidmann et al.
D408,161 S 4/1999 Caruso
5,901,109 A 5/1999 Miura
5,934,758 A 8/1999 Ritch et al.
5,944,382 A 8/1999 Ambasz
5,951,109 A 9/1999 Roslund, Jr. et al.
5,964,503 A 10/1999 Inoue
5,975,634 A 11/1999 Knoblock et al.
5,979,985 A 11/1999 Bauer et al.
6,000,755 A 12/1999 Uhlenbrock
6,000,756 A 12/1999 Hybarger et al.
6,003,943 A 12/1999 Schneider
6,015,187 A 1/2000 Roslund, Jr. et al.
6,021,712 A 2/2000 Harrop
6,050,646 A 4/2000 Stenzel et al.
6,056,361 A 5/2000 Cvek
6,059,363 A 5/2000 Roslund, Jr. et al.
6,079,785 A 6/2000 Peterson et al.
6,086,153 A 7/2000 Heidmann et al.
6,099,076 A 8/2000 Nagel et al.
6,109,694 A 8/2000 Kurtz
6,120,097 A 9/2000 Perry et al.
6,176,548 B1 1/2001 Thole et al.
D437,497 S 2/2001 Brauning
6,209,958 B1 4/2001 Thole
6,213,552 B1 4/2001 Miotto
6,224,155 B1 5/2001 DeKraker et al.
6,224,160 B1 * 5/2001 Takeuchi ..... A47C 3/00 297/452.55 X
6,231,125 B1 5/2001 Maeda
6,234,573 B1 5/2001 Roder et al.
6,238,000 B1 5/2001 Hallmark et al.
D445,580 S 7/2001 Pennington et al.
6,254,190 B1 7/2001 Gregory
6,257,665 B1 7/2001 Nagamitsu et al.
D446,954 S 8/2001 Sottsass
6,279,998 B1 8/2001 Chu et al.
6,279,999 B1 8/2001 Lee et al.
6,286,900 B1 9/2001 Roark
D449,172 S 10/2001 Van De Riet et al.
D449,938 S 11/2001 Vanderiet et al.
6,341,822 B2 1/2002 Apissomian
6,361,110 B2 3/2002 Roslund, Jr. et al.
6,361,117 B1 3/2002 Tate
D455,571 S 4/2002 Van De Riet et al.
D456,160 S 4/2002 Van De Riet et al.
D456,164 S 4/2002 Vanderiet et al.
6,367,876 B2 4/2002 Caruso
6,378,944 B1 4/2002 Weisser
D456,627 S 5/2002 Pearce et al.
D457,739 S 5/2002 Pearce et al.
6,386,634 B1 5/2002 Stumpf et al.
6,394,546 B1 5/2002 Knoblock et al.
6,398,309 B1 6/2002 Chen
D460,870 S 7/2002 Van De Riet et al.
D461,660 S 8/2002 Koepke et al.
D461,661 S 8/2002 Koepke et al.
6,439,661 B1 8/2002 Bräuning
D462,536 S 9/2002 Levy
D463,174 S 9/2002 Chu
6,447,063 B1 9/2002 Beggs
6,450,577 B1 9/2002 Roslund, Jr.
6,481,801 B1 11/2002 Schmale
6,511,128 B2 * 1/2003 Piretti ..... A47C 7/402 297/300.4
6,523,897 B2 2/2003 Pan
6,523,898 B1 2/2003 Ball et al.
6,536,841 B1 3/2003 Pearce et al.
D474,346 S 5/2003 Saylor et al.
D474,926 S 5/2003 Koepke et al.
6,557,939 B1 5/2003 Bräuning
6,572,190 B2 6/2003 Koepke et al.
D476,821 S 7/2003 Kiepke et al.
6,588,842 B2 7/2003 Stumpf
6,588,844 B1 7/2003 Stenzel
6,598,251 B2 7/2003 Habboub et al.
6,598,937 B2 7/2003 Caruso et al.
6,609,755 B2 8/2003 Koepke et al.
6,616,228 B2 9/2003 Heidmann
6,626,497 B2 9/2003 Nagamitsu et al.
6,632,756 B1 10/2003 Waldrop et al.
6,644,741 B2 11/2003 Nelson et al.
6,669,294 B2 12/2003 Kinoshita et al.
6,669,301 B1 12/2003 Funk et al.
6,679,553 B2 1/2004 Battey et al.
6,688,690 B2 2/2004 Watson et al.
6,688,698 B1 2/2004 Chou et al.
6,692,075 B2 2/2004 Sander et al.
6,692,077 B1 2/2004 Beggs et al.
6,695,404 B2 2/2004 Bruske
6,695,410 B2 2/2004 Hsia
D487,197 S 3/2004 Edwards et al.
6,698,839 B2 3/2004 Ballendat
6,701,550 B2 3/2004 Baeriswyl
6,709,057 B2 3/2004 Sander et al.
6,709,058 B1 3/2004 Diffrient
6,710,244 B1 3/2004 Pferschy
6,722,735 B2 4/2004 Lucci et al.
6,722,741 B2 4/2004 Stumpf et al.
6,729,688 B2 5/2004 Erne
6,729,691 B2 5/2004 Koepke et al.
6,733,084 B2 5/2004 Butler
6,739,663 B2 5/2004 Gevaert
6,749,261 B2 6/2004 Knoblock et al.
6,752,459 B2 6/2004 Deisig
6,755,467 B1 6/2004 Chu
6,755,473 B2 6/2004 Reed et al.
6,761,406 B2 7/2004 Kinoshita et al.
6,771,312 B2 8/2004 Kamishima et al.
6,779,846 B2 8/2004 Spendlove et al.
6,779,847 B2 8/2004 Klein
6,783,184 B2 8/2004 DiBattista et al.
6,786,544 B1 9/2004 Muraishi
6,786,548 B2 9/2004 Pearce et al.
6,802,566 B2 10/2004 Prince et al.
6,811,215 B2 11/2004 Horiki et al.
6,811,218 B2 11/2004 Deimen et al.
6,814,412 B2 11/2004 Cramb, III et al.
6,817,667 B2 11/2004 Pennington et al.
6,820,388 B2 11/2004 Newhouse et al.
6,820,933 B2 11/2004 Fereira Da Silva
6,820,934 B2 11/2004 Ware et al.
6,820,935 B1 11/2004 Cioncada
D499,564 S 12/2004 Meda
D500,211 S 12/2004 Kosh et al.
6,837,546 B2 1/2005 VanDeRiet et al.
D501,333 S 2/2005 Piretti
6,863,346 B2 3/2005 Zund
6,869,142 B2 3/2005 Heidmann et al.
6,871,909 B2 3/2005 Hobb et al.
6,874,852 B2 4/2005 Footitt

(56) References Cited

U.S. PATENT DOCUMENTS

| | | | |
|---|---|---|---|
| 6,877,816 | B1 | 4/2005 | Farmont |
| 6,880,886 | B2 | 4/2005 | Bodnar et al. |
| 6,890,030 | B2 | 5/2005 | Wilkerson et al. |
| 6,896,327 | B1 | 5/2005 | Barile, Sr. |
| 6,896,328 | B2 | 5/2005 | Goodworth |
| 6,896,329 | B2 | 5/2005 | Sander et al. |
| 6,899,398 | B2 | 5/2005 | Coffield |
| 6,908,159 | B2 | 6/2005 | Prince et al. |
| 6,910,736 | B2 | 6/2005 | White |
| 6,910,741 | B2 | 6/2005 | Footitt |
| 6,924,300 | B2 | 8/2005 | Momose et al. |
| 6,929,327 | B2 | 8/2005 | Piretti |
| 6,932,430 | B2 | 8/2005 | Bedford et al. |
| 6,932,431 | B2 | 8/2005 | Koch et al. |
| 6,935,690 | B2 | 8/2005 | Lucci et al. |
| D509,388 | S | 9/2005 | Koepke et al. |
| 6,942,300 | B2 | 9/2005 | Numa et al. |
| 6,945,601 | B1 | 9/2005 | Wu |
| 6,945,602 | B2 | 9/2005 | Fookes et al. |
| 6,945,605 | B2 | 9/2005 | Kinoshita et al. |
| D510,668 | S | 10/2005 | Eldøy |
| 6,951,085 | B2 | 10/2005 | Hodges et al. |
| 6,957,862 | B2 | 10/2005 | Chen |
| 6,959,965 | B2 | 11/2005 | Diffrient |
| 6,966,604 | B2 | 11/2005 | Stumpf et al. |
| 6,974,189 | B2 | 12/2005 | Machael et al. |
| 6,983,997 | B2 | 1/2006 | Wilkerson et al. |
| 6,986,549 | B2 | 1/2006 | Kniese |
| 7,004,543 | B2 | 2/2006 | Caruso et al. |
| D516,831 | S | 3/2006 | Eldøy |
| 7,021,718 | B2 | 4/2006 | Coffield et al. |
| 7,029,071 | B2 | 4/2006 | Watson et al. |
| 7,032,971 | B2 | 4/2006 | Williams |
| 7,036,881 | B1 | 5/2006 | Beggs |
| 7,048,335 | B2 | 5/2006 | Norman et al. |
| 7,055,911 | B2 | 6/2006 | Simpson et al. |
| 7,066,537 | B2 | 6/2006 | Coffield et al. |
| 7,066,538 | B2 | 6/2006 | Machael et al. |
| 7,066,550 | B1 | 6/2006 | Su |
| D525,445 | S | 7/2006 | Liu et al. |
| D525,446 | S | 7/2006 | Farber |
| 7,070,242 | B2 | 7/2006 | Mears et al. |
| 7,096,549 | B2 | 8/2006 | Coffield |
| 7,097,247 | B2 | 8/2006 | Battey et al. |
| 7,097,249 | B2 | 8/2006 | Igarashi et al. |
| 7,108,322 | B2 | 9/2006 | Erker |
| 7,118,177 | B2 | 10/2006 | Piretti |
| 7,147,285 | B2 | 12/2006 | Lin |
| 7,152,929 | B2 | 12/2006 | Wu |
| 7,159,943 | B2 | 1/2007 | Costaglia |
| 7,165,811 | B2 | 1/2007 | Bodnar et al. |
| 7,185,910 | B2 | 3/2007 | Beauchesne et al. |
| 7,204,557 | B1 | 4/2007 | Burton |
| 7,207,630 | B1 | 4/2007 | Reynolds |
| D542,574 | S | 5/2007 | Johnson |
| D543,399 | S | 5/2007 | Johnson |
| 7,213,880 | B2 | 5/2007 | Schmitz et al. |
| 7,213,886 | B2 | 5/2007 | Schmitz et al. |
| 7,226,130 | B2 | 6/2007 | Tubergen et al. |
| 7,234,772 | B2 | 6/2007 | Wells |
| 7,234,774 | B2 | 6/2007 | Heidmann et al. |
| 7,234,775 | B2 | 6/2007 | Serber |
| 7,237,841 | B2 | 7/2007 | Norman et al. |
| 7,243,993 | B2 | 7/2007 | Igarashi et al. |
| 7,243,997 | B1 | 7/2007 | Tomero |
| 7,246,859 | B2 | 7/2007 | Igarashi et al. |
| 7,249,802 | B2 | 7/2007 | Schmitz et al. |
| 7,250,091 | B2 | 7/2007 | Gupta et al. |
| 7,251,917 | B2 | 8/2007 | Cvek |
| 7,262,371 | B2 | 8/2007 | Makwinski et al. |
| 7,264,311 | B2 | 9/2007 | Heidmann |
| 7,270,378 | B2 | 9/2007 | Wilkerson et al. |
| 7,273,252 | B2 | 9/2007 | Iijima et al. |
| D551,868 | S | 10/2007 | Chu |
| D552,368 | S | 10/2007 | Scheper et al. |
| D553,380 | S | 10/2007 | Natuzzi |
| 7,275,788 | B2 | 10/2007 | Dettmann et al. |
| 7,275,793 | B2 | 10/2007 | Fujita et al. |
| 7,278,688 | B1 | 10/2007 | Hung |
| 7,281,764 | B2 | 10/2007 | Thole |
| 7,287,815 | B2 | 10/2007 | Leguen et al. |
| 7,293,833 | B2 | 11/2007 | Takeuchi et al. |
| D557,025 | S | 12/2007 | Chen |
| D559,002 | S | 1/2008 | Williams et al. |
| 7,320,503 | B2 | 1/2008 | Eysing |
| D560,918 | S | 2/2008 | Fuksas |
| 7,334,845 | B2 | 2/2008 | Peterson et al. |
| D564,264 | S | 3/2008 | Smith et al. |
| 7,344,194 | B2 | 3/2008 | Maier et al. |
| 7,347,495 | B2 | 3/2008 | Beyer et al. |
| 7,360,835 | B2 | 4/2008 | Tubergen et al. |
| 7,364,233 | B2 | 4/2008 | Donati |
| D571,568 | S | 6/2008 | Overthun et al. |
| 7,393,057 | B2 | 7/2008 | Fraser |
| 7,396,077 | B2 | 7/2008 | Boulva |
| 7,396,081 | B2 | 7/2008 | Matern et al. |
| 7,406,733 | B2 | 8/2008 | Coffiled et al. |
| 7,408,114 | B2 | 8/2008 | VanderVelde et al. |
| 7,416,256 | B2 | 8/2008 | Fujita et al. |
| 7,419,215 | B2 | 9/2008 | Wilkerson et al. |
| 7,419,222 | B2 | 9/2008 | Schmitz et al. |
| 7,425,037 | B2 | 9/2008 | Schmitz et al. |
| 7,425,039 | B2 | 9/2008 | Lin |
| 7,429,081 | B2 | 9/2008 | Roslund et al. |
| 7,434,879 | B2 | 10/2008 | Ueda et al. |
| 7,434,880 | B2 | 10/2008 | Ronnestad |
| 7,434,888 | B2 | 10/2008 | Lin |
| 7,441,758 | B2 | 10/2008 | Coffield et al. |
| 7,441,839 | B2 | 10/2008 | Pennington et al. |
| D579,695 | S | 11/2008 | Wu |
| 7,490,395 | B2 | 2/2009 | Coffield et al. |
| 7,513,570 | B2 | 4/2009 | Roslund et al. |
| 7,517,024 | B2 | 4/2009 | Cvek |
| D596,871 | S | 7/2009 | Farber |
| 7,566,099 | B2 | 7/2009 | Catanzarite et al. |
| 7,568,763 | B2 | 8/2009 | Bedford et al. |
| 7,568,765 | B2 | 8/2009 | Bräuning |
| 7,568,768 | B1 | 8/2009 | Tsai |
| D600,052 | S | 9/2009 | Smith et al. |
| 7,589,286 | B2 | 9/2009 | VanderVelde et al. |
| 7,594,700 | B2 | 9/2009 | Stumpf et al. |
| 7,600,820 | B2 | 10/2009 | Bouche et al. |
| 7,604,298 | B2 | 10/2009 | Peterson et al. |
| D604,527 | S | 11/2009 | Ooki et al. |
| D604,535 | S | 11/2009 | Parker et al. |
| 7,625,045 | B2 | 12/2009 | Hatcher et al. |
| 7,647,714 | B2 | 1/2010 | Coffield et al. |
| 7,648,201 | B2 | 1/2010 | Eysing |
| D609,482 | S | 2/2010 | Englisch et al. |
| 7,654,616 | B2 | 2/2010 | Kinoshita et al. |
| 7,654,617 | B2 | 2/2010 | Farnsworth |
| 7,665,805 | B2 | 2/2010 | Ueda |
| D610,824 | S | 3/2010 | Piretti |
| 7,673,942 | B2 | 3/2010 | Tuckey et al. |
| 7,681,952 | B2 | 3/2010 | Piretti |
| 7,695,067 | B2 | 4/2010 | Goetz et al. |
| D616,213 | S | 5/2010 | Parker et al. |
| 7,708,349 | B2 | 5/2010 | Chen |
| 7,712,833 | B2 | 5/2010 | Ueda |
| 7,712,834 | B2 | 5/2010 | Knoboick et al. |
| 7,716,797 | B2 | 5/2010 | Kismarton et al. |
| 7,717,513 | B2 | 5/2010 | Ueda |
| 7,727,519 | B2 | 5/2010 | Kismarton et al. |
| 7,731,295 | B2 | 6/2010 | Lin |
| 7,735,923 | B2 | 6/2010 | Roslund et al. |
| 7,753,447 | B2 | 7/2010 | Sulzer |
| 7,770,973 | B2 | 8/2010 | Gehner et al. |
| 7,784,870 | B2 | 8/2010 | Machaet et al. |
| 7,794,017 | B2 | 9/2010 | Kan et al. |
| 7,794,022 | B2 | 9/2010 | Caruso et al. |
| 7,798,573 | B2 | 9/2010 | Pennington et al. |
| 7,806,478 | B1 | 10/2010 | Cvek |
| 7,806,481 | B2 | 10/2010 | Ebertein |
| 7,815,257 | B2 | 10/2010 | Costaglia et al. |

(56) References Cited

U.S. PATENT DOCUMENTS 7,823,973 B2 11/2010 Dragusin
7,837,265 B2 11/2010 Machael et al.
7,837,272 B2 11/2010 Masunaga et al.
7,841,664 B2 11/2010 Holdrege et al.
7,841,665 B2 11/2010 Geister et al.
7,841,666 B2 11/2010 Schmitz et al.
7,851,390 B2 12/2010 Salzmann et al.
7,857,389 B2 12/2010 Ueda
7,857,390 B2 12/2010 Schmitz et al.
7,862,120 B2 1/2011 Ueda
7,866,750 B2 1/2011 Bock
7,878,598 B2 2/2011 Oda
7,887,131 B2 2/2011 Chadwick et al.
7,887,135 B2 2/2011 Oda
7,887,138 B2 2/2011 Chen
7,896,439 B2 3/2011 Kan et al.
7,922,248 B2 4/2011 Aldrich et al.
7,926,879 B2 4/2011 Schmitz et al.
7,926,880 B2 4/2011 Heidmann et al.
7,931,257 B2 4/2011 VanDeRiet et al.
D637,423 S 5/2011 Behar et al.
D637,838 S 5/2011 Piretti
7,946,651 B2 5/2011 Donati
D639,091 S 6/2011 Behar et al.
7,971,935 B2 7/2011 Saez et al.
7,992,936 B2 8/2011 Schmitz et al.
7,992,937 B2 8/2011 Plikat et al.
7,997,652 B2 8/2011 Roslund et al.
8,002,351 B2 * 8/2011 Golynsky ..... A47C 7/445 297/301.1
8,025,334 B2 9/2011 Schmitz et al.
8,025,335 B2 9/2011 Gehner
D646,074 S 10/2011 Cantarutti
8,029,060 B2 10/2011 Parker et al.
8,029,066 B2 10/2011 Su
D647,738 S 11/2011 Chen
8,061,775 B2 11/2011 Diffrient
D652,657 S 1/2012 Behar et al.
D653,061 S 1/2012 Behar et al.
8,087,727 B2 * 1/2012 Parker ..... A47C 7/445 297/300.2
8,096,615 B2 1/2012 Parker et al.
8,104,838 B2 1/2012 Tsai
D654,291 S 2/2012 Pearson et al.
8,109,576 B2 2/2012 Lin
8,113,582 B2 2/2012 Liu
8,128,175 B2 3/2012 Groelsma et al.
D657,166 S 4/2012 Behar et al.
8,162,397 B2 4/2012 Booth et al.
D660,056 S 5/2012 Diffrient
8,167,375 B2 5/2012 Catanzarite et al.
8,172,332 B2 5/2012 Masunaga et al.
8,100,476 B2 6/2012 Jenkins
8,210,611 B2 7/2012 Aldrich et al.
8,215,710 B2 7/2012 Erker
8,226,167 B2 7/2012 Bruck et al.
8,235,468 B2 8/2012 Fookes et al.
8,246,113 B2 8/2012 Bock
8,246,117 B2 8/2012 Melhuish et al.
8,251,454 B2 8/2012 Tsukiji et al.
8,262,162 B2 9/2012 Castro, Jr. et al.
8,272,693 B2 9/2012 Hall et al.
D669,279 S 10/2012 Eldøy
8,282,169 B2 10/2012 Schmitz et al.
8,282,172 B2 10/2012 Schmitz et al.
8,297,701 B2 10/2012 Machael et al.
8,297,708 B2 10/2012 Mizobata et al.
8,313,140 B2 11/2012 Niitsuma et al.
D673,385 S 1/2013 Lu
D678,690 S 3/2013 Eldøy
8,388,064 B2 3/2013 Bertolini et al.
D680,345 S 4/2013 Xingchang
8,408,647 B2 4/2013 Wu
8,414,073 B2 4/2013 Schmitz et al.
8,414,075 B2 4/2013 Ko
8,419,133 B2 4/2013 Hoyt et al.
8,419,135 B2 4/2013 Moeseneder et al.
D683,150 S 5/2013 Smith et al.
8,449,037 B2 5/2013 Behar et al.
8,459,746 B2 6/2013 Lai
8,469,454 B2 6/2013 Holt et al.
8,480,171 B2 7/2013 Chadwick et al.
8,544,957 B2 10/2013 Lin
8,544,958 B2 10/2013 Holtzinger et al.
8,550,564 B1 10/2013 Kismarton et al.
8,562,073 B2 10/2013 Niitsuma et al.
8,567,864 B2 10/2013 Deisig et al.
8,579,376 B2 11/2013 Chen
8,602,494 B2 12/2013 Cvek
8,602,501 B2 12/2013 Walker et al.
8,613,481 B2 12/2013 Parker et al.
8,616,640 B2 12/2013 Van Hekken
8,616,655 B2 12/2013 Jung
8,622,474 B2 1/2014 Jenkins
8,646,839 B2 2/2014 Moreschi
8,668,265 B2 3/2014 Parker et al.
8,668,267 B2 3/2014 Piretti
8,671,482 B2 3/2014 Willingham
D703,458 S 4/2014 Nakamura et al.
D703,459 S 4/2014 Nakamura et al.
8,690,249 B2 4/2014 Kang et al.
8,691,370 B2 4/2014 Brill et al.
8,695,306 B2 4/2014 Cvek
D704,488 S 5/2014 Massaud
D704,945 S 5/2014 Massaud
D705,561 S 5/2014 Massaud
8,714,645 B2 5/2014 Cvek
D706,547 S 6/2014 Smtih et al.
8,752,896 B2 6/2014 Takeuchi et al.
D708,466 S 7/2014 Massaud
8,764,110 B2 7/2014 Hsuan-Chin
8,777,312 B2 7/2014 Diffrient
8,777,318 B2 7/2014 Chen
8,794,701 B2 8/2014 Nakayama et al.
8,820,835 B2 9/2014 Minino et al.
D714,563 S 10/2014 Amdal et al.
8,857,033 B2 10/2014 Coffield et al.
8,857,909 B2 10/2014 Bock
D717,555 S 11/2014 Massaud
8,876,209 B2 11/2014 Peterson et al.
8,888,183 B2 11/2014 Parker et al.
8,899,680 B2 12/2014 Meier et al.
8,926,016 B2 1/2015 Behar et al.
8,939,507 B2 1/2015 Thomaschewski et al.
8,944,507 B2 2/2015 Goetz
8,960,699 B2 2/2015 Springle et al.
8,960,796 B2 2/2015 Aldrich et al.
D724,367 S 3/2015 Sander
8,967,724 B2 3/2015 Battey et al.
8,967,726 B2 3/2015 Schmitz et al.
8,973,995 B2 3/2015 Donati
D727,076 S 4/2015 Usumoto
8,998,322 B2 4/2015 Horiki et al.
8,998,337 B2 4/2015 Miyamoto
8,998,338 B2 * 4/2015 Vander Veen ..... A47C 1/03261 297/452.55
8,998,339 B2 4/2015 Peterson et al.
9,004,597 B2 4/2015 Battey et al.
9,010,839 B2 4/2015 Schijve et al.
D728,292 S 5/2015 Ooki
9,022,482 B2 5/2015 Morio et al.
9,027,997 B2 * 5/2015 Battey ..... A47C 7/462 297/300.1 X
9,028,001 B2 5/2015 Battey et al.
9,033,421 B2 * 5/2015 Wilkinson ..... A47C 1/03 297/452.64
9,033,431 B1 5/2015 Wlkinson et al.
9,039,093 B2 5/2015 Nishiura et al.
9,045,064 B2 6/2015 Weigert
9,049,936 B2 6/2015 Leone et al.
9,061,621 B2 6/2015 Hisamoto
9,095,217 B2 8/2015 Oda
9,132,760 B2 9/2015 Matsumoto et al.
9,155,393 B2 10/2015 Hunford et al.

(56) References Cited

U.S. PATENT DOCUMENTS 9,161,627 B2 10/2015 Donati
9,168,855 B2 10/2015 Evans et al.
D742,674 S 11/2015 Wilkinson et al.
9,211,826 B2 12/2015 Matsumoto et al.
9,278,634 B2 3/2016 Mathews et al.
9,289,067 B2 3/2016 Meyer et al.
9,301,615 B2 4/2016 Behar et al.
9,326,613 B2 5/2016 Cvek
9,332,851 B2 5/2016 Machael et al.
9,392,872 B2 7/2016 Saint Pierre et al.
D763,612 S 8/2016 Goetz
9,409,467 B2 8/2016 Peterson et al.
9,414,673 B2 8/2016 Behar et al.
9,427,086 B2 8/2016 Willingham
D767,318 S 9/2016 Kubryk
9,462,891 B2 10/2016 Kikuchi et al.
9,480,339 B2 11/2016 Cvek
9,486,081 B2 * 11/2016 Sander ..... A47C 7/445
9,498,066 B2 11/2016 Christianson et al.
9,504,325 B2 11/2016 Sander et al.
D773,872 S 12/2016 Kim
9,510,684 B2 12/2016 Schmitz et al.
9,521,907 B2 12/2016 Romero
9,560,917 B2 2/2017 Roslund et al.
9,578,968 B2 2/2017 Masunaga et al.
9,622,579 B2 4/2017 Wilkinson et al.
D785,353 S 5/2017 Zhou
D786,326 S 5/2017 Jeong
9,648,957 B2 5/2017 Su
9,661,930 B2 5/2017 Norman et al.
D789,129 S 6/2017 Fromme-Ruthmann
9,668,580 B2 6/2017 Schmitz et al.
9,693,632 B2 7/2017 Duke
9,700,142 B2 7/2017 Wagner
9,713,380 B2 7/2017 Gehner et al.
9,826,836 B2 11/2017 Sander et al.
9,826,839 B2 11/2017 Battery et al.
9,833,074 B2 12/2017 Bohmann et al.
9,883,746 B2 * 2/2018 Piretti ..... A47C 1/03277
9,913,539 B2 3/2018 Potrykus et al.
9,918,552 B2 3/2018 Battey et al.
10,016,080 B2 7/2018 Schmitz et al.
10,017,082 B2 7/2018 Zwaan
10,021,984 B2 7/2018 Ludwig et al.
10,034,548 B2 7/2018 Willingham
10,098,466 B2 10/2018 Donati
10,111,525 B2 10/2018 Sander et al.
10,130,184 B2 11/2018 Lin et al.
10,159,351 B1 12/2018 Alexander et al.
10,165,862 B2 1/2019 Schmitz et al.
10,172,464 B2 1/2019 Cassaday
10,172,465 B2 1/2019 Machael et al.
10,173,567 B2 1/2019 Madrigal et al.
10,182,657 B2 1/2019 Beyer et al.
10,194,750 B2 2/2019 Ludwig et al.
10,206,507 B2 2/2019 Battey et al.
10,226,129 B2 3/2019 Christianson et al.
10,226,893 B2 3/2019 Coffield et al.
10,258,820 B2 4/2019 Harlow
D847,880 S 5/2019 Tien et al.
10,299,595 B2 5/2019 Difffrient et al.
10,321,763 B2 6/2019 Bonneywell
D874,202 S 2/2020 Schmitz et al.
2001/0028188 A1 10/2001 Stumpf et al.
2001/0029781 A1 10/2001 Tai et al.
2001/0030457 A1 10/2001 Gregory
2001/0050500 A1 12/2001 Piretti
2002/0000745 A1 1/2002 Conte
2002/0021040 A1 2/2002 Caruso et al.
2002/0041118 A1 4/2002 Howell
2002/0109384 A1 8/2002 Hansen
2002/0190552 A1 12/2002 Koepke et al.
2003/0075961 A1 4/2003 Struppler et al.
2003/0085607 A1 5/2003 Jones et al.
2003/0132653 A1 7/2003 Thole
2003/0137171 A1 7/2003 Deimen et al.
2003/0178882 A1 9/2003 Schmitz et al.
2003/0184140 A1 10/2003 Bruske
2003/0189367 A1 10/2003 Erker
2003/0221741 A1 12/2003 Schwartz
2004/0051358 A1 3/2004 Bodnar et al.
2004/0124689 A1 7/2004 Numa et al.
2004/0160109 A1 8/2004 Bottemiller
2004/0195882 A1 10/2004 White
2004/0217521 A1 11/2004 DiBattista et al.
2004/0224127 A1 11/2004 DiBattista et al.
2004/0227387 A1 11/2004 Matern et al.
2004/0245828 A1 12/2004 Norman et al.
2004/0262977 A1 12/2004 DiBattista et al.
2005/0035638 A1 2/2005 Pennington et al.
2005/0099055 A1 5/2005 Koepke et al.
2005/0116525 A1 6/2005 Holcomb et al.
2005/0248205 A1 11/2005 Neil et al.
2005/0264071 A1 12/2005 Costaglia
2006/0080817 A1 4/2006 Klinker
2006/0101724 A1 5/2006 Hoekstra et al.
2006/0181126 A1 8/2006 Eysing
2006/0202530 A1 9/2006 Lin
2006/0238009 A1 10/2006 Igarashi et al.
2006/0250029 A1 11/2006 Wu
2006/0255636 A1 11/2006 Donati
2007/0001497 A1 1/2007 Diffeient
2007/0007812 A1 1/2007 Doricko
2007/0057562 A1 3/2007 Gregory et al.
2007/0102987 A1 5/2007 Chen
2007/0108831 A1 5/2007 Ueda
2007/0126271 A1 6/2007 Brodeur
2007/0170759 A1 7/2007 Nolan et al.
2007/0222265 A1 9/2007 Machael et al.
2007/0241599 A1 10/2007 Hodgdon
2007/0262634 A1 11/2007 Brill et al.
2008/0067848 A1 3/2008 Brauning
2008/0079307 A1 4/2008 Su
2008/0122285 A1 5/2008 Lin
2008/0217977 A1 9/2008 Aldrich et al.
2008/0258531 A1 10/2008 Lu
2008/0290712 A1 * 11/2008 Parker ..... A47C 7/14
297/354.11
2009/0015047 A1 1/2009 Baumann
2009/0018833 A1 1/2009 Kozat et al.
2009/0020165 A1 1/2009 Oelerich
2009/0021065 A1 1/2009 Brauning
2009/0085388 A1 4/2009 Parker et al.
2009/0091170 A1 4/2009 Grentzelius et al.
2009/0102268 A1 4/2009 Schmitz et al.
2009/0146476 A1 6/2009 Kan et al.
2009/0211194 A1 8/2009 Fyfe et al.
2009/0261644 A1 10/2009 Piretti
2010/0007190 A1 1/2010 Johnson et al.
2010/0078975 A1 4/2010 Kang
2010/0117419 A1 5/2010 Schmitz et al.
2010/0164263 A1 7/2010 Malenotti
2010/0289308 A1 11/2010 Schmitz et al.
2011/0062758 A1 3/2011 Wiese
2011/0074202 A1 3/2011 Su
2011/0181086 A1 7/2011 Pfeifer et al.
2011/0198907 A1 8/2011 Masunaga et al.
2011/0215623 A1 9/2011 Tsai
2011/0233979 A1 9/2011 An
2011/0241405 A1 10/2011 Slagh
2011/0266863 A1 11/2011 Zhou
2012/0025574 A1 2/2012 Wilkinson et al.
2012/0056451 A1 3/2012 Dinati
2012/0091769 A1 4/2012 Parker et al.
2012/0119551 A1 5/2012 Brncick et al.
2012/0139321 A1 6/2012 Wu
2012/0161483 A1 6/2012 Hayashi
2012/0181831 A1 7/2012 Meier et al.
2012/0228911 A1 9/2012 Piretti
2013/0069414 A1 3/2013 Ko
2013/0082499 A1 4/2013 Schmitz et al.
2013/0099534 A1 4/2013 Barile, Jr. et al.
2013/0099548 A1 4/2013 Schmitz et al.
2013/0119744 A1 5/2013 Panozzo et al.

(56) References Cited

U.S. PATENT DOCUMENTS

| | | | |
|---|---|---|---|
| 2013/0134756 | A1 | 5/2013 | Hisamoto |
| 2013/0169017 | A1 | 7/2013 | Masunaga et al. |
| 2013/0207427 | A1 | 8/2013 | Masunaga et al. |
| 2013/0278025 | A1 | 10/2013 | Wakabayashi et al. |
| 2013/0313878 | A1 | 11/2013 | Lin |
| 2013/0341980 | A1 | 12/2013 | Halliday et al. |
| 2014/0054947 | A1 | 2/2014 | Su |
| 2014/0077429 | A1 | 3/2014 | Battey et al. |
| 2014/0077548 | A1 | 3/2014 | Peterson et al. |
| 2014/0077551 | A1 | 3/2014 | Battey et al. |
| 2014/0077573 | A1 | 3/2014 | Schneider et al. |
| 2014/0084652 | A1 | 3/2014 | Norman et al. |
| 2014/0103688 | A1 | 4/2014 | Wilson |
| 2014/0110983 | A1 | 4/2014 | Sander et al. |
| 2014/0125104 | A1 | 5/2014 | Hasegawa et al. |
| 2014/0132051 | A1 | 5/2014 | Freedman |
| 2014/0139004 | A1 | 5/2014 | Matsumoto et al. |
| 2014/0152064 | A1 | 6/2014 | Sander et al. |
| 2014/0175849 | A1 | 6/2014 | Berti et al. |
| 2014/0183914 | A1 | 7/2014 | Cvek |
| 2014/0183915 | A1 | 7/2014 | Deisig et al. |
| 2014/0265493 | A1 | 9/2014 | Machael et al. |
| 2014/0292052 | A1 | 10/2014 | Parker et al. |
| 2014/0354026 | A1 | 12/2014 | Gorgi |
| 2015/0044419 | A1 | 2/2015 | Carson, Jr. et al. |
| 2015/0091353 | A1 | 4/2015 | Horn |
| 2015/0108809 | A1 | 4/2015 | Romero |
| 2015/0130254 | A1 | 4/2015 | Yamaguchi et al. |
| 2015/0123441 | A1 | 5/2015 | Duke |
| 2015/0147517 | A1 | 5/2015 | Salzmann |
| 2015/0157131 | A1 | 6/2015 | Battey et al. |
| 2015/0216308 | A1 | 8/2015 | Wilkinson et al. |
| 2015/0265053 | A1 | 9/2015 | Battey et al. |
| 2015/0265058 | A1 | 9/2015 | Igarashi et al. |
| 2015/0296989 | A1 | 10/2015 | Machael et al. |
| 2015/0298587 | A1 | 10/2015 | Machael et al. |
| 2015/0314501 | A1 | 11/2015 | Maslakow |
| 2015/0343747 | A1 | 12/2015 | Meermann et al. |
| 2016/0026102 | A1 | 1/2016 | Miyata et al. |
| 2016/0029801 | A1 | 2/2016 | Potrykus et al. |
| 2016/0081477 | A1 | 3/2016 | Coffield |
| 2016/0128481 | A1* | 5/2016 | Piretti ..... A47C 1/03238 297/300.1 |
| 2016/0135603 | A1 | 5/2016 | Chan et al. |
| 2016/0296026 | A1 | 10/2016 | Ludwig et al. |
| 2016/0368405 | A1 | 12/2016 | Ishii et al. |
| 2017/0079435 | A1 | 3/2017 | Donati |
| 2017/0079439 | A1 | 3/2017 | Schmitz et al. |
| 2017/0102987 | A1 | 4/2017 | Malnati |
| 2017/0127839 | A1 | 5/2017 | Cassaday |
| 2017/0135487 | A1 | 5/2017 | Donati |
| 2018/0160613 | A1 | 6/2018 | Battey et al. |
| 2018/0310721 | A1 | 11/2018 | Schmitz et al. |
| 2018/0332967 | A1 | 11/2018 | Jin et al. |
| 2018/0352961 | A1 | 12/2018 | Deevers et al. |
| 2019/0021500 | A1 | 1/2019 | Sander et al. |
| 2019/0038033 | A1 | 2/2019 | Schmitz et al. |
| 2019/0045934 | A1 | 2/2019 | Deisig et al. |
| 2020/0085194 | A1 | 3/2020 | Maier et al. |

FOREIGN PATENT DOCUMENTS

| | | | |
|---|---|---|---|
| BE | 702816 | A | 8/1967 |
| CA | 1235055 | | 4/1988 |
| CA | 2395448 | A1 | 6/2002 |
| CA | 2437074 | C | 10/2009 |
| CA | 3026655 | A1 | 12/2017 |
| CN | 1531401 | A | 9/2004 |
| CN | 1177556 | C | 12/2004 |
| CN | 201360764 | Y | 12/2009 |
| CN | 201436914 | U | 4/2010 |
| CN | 201958277 | U | 9/2011 |
| CN | 102476448 | A | 5/2012 |
| CN | 201658054 | U | 12/2012 |
| CN | 103876498 | A | 6/2014 |
| CN | 203662373 | U | 6/2014 |
| CN | 104736018 | A | 6/2015 |
| CN | 109310209 | A | 2/2019 |
| DE | 69 25 165 | U | 10/1969 |
| DE | 1 404 657 | A1 | 1/1970 |
| DE | 2026 929 | | 12/1970 |
| DE | 1 779 854 | A1 | 10/1971 |
| DE | 2 222 840 | A1 | 5/1972 |
| DE | 2 241 209 | | 8/1972 |
| DE | 24 54 471 | A1 | 5/1976 |
| DE | 27 57 652 | A1 | 6/1979 |
| DE | 29 31 072 | A1 | 2/1980 |
| DE | 311 6459 | A1 | 11/1982 |
| DE | 31 39 448 | A1 | 4/1983 |
| DE | 32 03 401 | A1 | 8/1983 |
| DE | 84 19 826 | U1 | 7/1984 |
| DE | 33 22 450 | A1 | 1/1985 |
| DE | 34 23 857 | A1 | 1/1985 |
| DE | 35 30 868 | A1 | 3/1987 |
| DE | 36 05 809 | A1 | 8/1987 |
| DE | 36 18 705 | A1 | 12/1987 |
| DE | 37 35 256 | A1 | 4/1989 |
| DE | 37 37 491 | A1 | 5/1989 |
| DE | 38 21 042 | A1 | 12/1989 |
| DE | 40 23 607 | A1 | 1/1992 |
| DE | 41 21 768 | C1 | 10/1992 |
| DE | 42 35 691 | A1 | 6/1993 |
| DE | 42 16 159 | A1 | 11/1993 |
| DE | 43 03 021 | A1 | 8/1994 |
| DE | 44 24 096 | | 1/1996 |
| DE | 44 24 096 | A1 | 1/1996 |
| DE | 44 33 663 | A1 | 3/1996 |
| DE | 44 42 246 | A1 | 5/1996 |
| DE | 196 07 136 | A1 | 8/1996 |
| DE | 29 704 906 | U1 | 5/1997 |
| DE | 297 04 906 | U1 | 5/1997 |
| DE | 196 11 345 | | 9/1997 |
| DE | 196 11 345 | A1 | 9/1997 |
| DE | 196 20 260 | A1 | 11/1997 |
| DE | 297 17 573 | U1 | 2/1998 |
| DE | 196 40 564 | A1 | 4/1998 |
| DE | 197 14 546 | | 10/1998 |
| DE | 197 14 546 | A1 | 10/1998 |
| DE | 199 30 922 | A1 | 5/2000 |
| DE | 199 21 153 | A1 | 11/2000 |
| DE | 100 12 034 | A1 | 9/2001 |
| DE | 100 51 840 | A1 | 5/2002 |
| DE | 101 22 945 | A1 | 12/2002 |
| DE | 203 06 685 | U1 | 8/2003 |
| DE | 20 2004 004 800 | U1 | 7/2004 |
| DE | 101 47 021 | B4 | 12/2004 |
| DE | 20 2006 006 678 | U1 | 7/2006 |
| DE | 20 2006 012 654 | U1 | 1/2007 |
| DE | 10 2005 054 125 | B3 | 5/2007 |
| DE | 20 2006 005 645 | U1 | 8/2007 |
| DE | 20 2006 005 645 | U1 | 9/2007 |
| DE | 20 2007 010 030 | U1 | 10/2007 |
| DE | 20 2007 001 395 | U1 | 7/2008 |
| DE | 10 2008 009 509 | A1 | 8/2009 |
| DE | 10 2009 019 232 | A1 | 11/2009 |
| DE | 20 2010 007 073 | U1 | 11/2010 |
| DE | 20 2010 008 739 | | 1/2012 |
| DE | 20 2012 005 465 | U1 | 10/2013 |
| DE | 10 2013 205 784 | A1 | 10/2014 |
| DE | 10 2013 022 122 | A1 | 7/2015 |
| DE | 10 2015 202 079 | A1 | 3/2016 |
| EP | 0 006 840 | A1 | 1/1980 |
| EP | 0 014 001 | A1 | 8/1980 |
| EP | 0 049 310 | A1 | 4/1982 |
| EP | 0 081 102 | A1 | 6/1983 |
| EP | 0 107 627 | A1 | 6/1983 |
| EP | 0 151 816 | A2 | 8/1985 |
| EP | 0 202 386 | A2 | 11/1986 |
| EP | 0 247 312 | A2 | 12/1987 |
| EP | 0 250 199 | A1 | 12/1987 |
| EP | 0 815 778 | A1 | 1/1988 |
| EP | 0 284 272 | A1 | 3/1988 |
| EP | 0 284 272 | A2 | 9/1988 |

(56) References Cited

FOREIGN PATENT DOCUMENTS

| | | | |
|---|---|---|---|
| EP | 0 298 928 | A2 | 1/1989 |
| EP | 0 339 089 | A1 | 11/1989 |
| EP | 0 552 388 | A1 | 7/1993 |
| EP | 0 559 185 | A1 | 9/1993 |
| EP | 0 578 276 | A1 | 1/1994 |
| EP | 0 591 932 | A1 | 4/1994 |
| EP | 0 592 369 | A1 | 4/1994 |
| EP | 0 678 260 | A1 | 10/1995 |
| EP | 0 860 355 | A1 | 2/1997 |
| EP | 0 839 478 | A1 | 5/1998 |
| EP | 0 870 443 | A2 | 10/1998 |
| EP | 0 982 180 | A1 | 3/1999 |
| EP | 0 960 586 | A2 | 12/1999 |
| EP | 0 982 179 | A2 | 3/2000 |
| EP | 1 040 999 | A2 | 10/2000 |
| EP | 1 066 776 | A1 | 1/2001 |
| EP | 1 161 905 | A1 | 12/2001 |
| EP | 1 316 651 | A2 | 6/2003 |
| EP | 1 447 029 | A1 | 8/2004 |
| EP | 1 559 348 | A2 | 1/2005 |
| EP | 1 785 065 | A1 | 5/2007 |
| EP | 1 785 067 | A1 | 5/2007 |
| EP | 1 785 068 | A1 | 5/2007 |
| EP | 1 785 070 | A1 | 5/2007 |
| EP | 1 785 076 | A1 | 5/2007 |
| EP | 1 808 096 | A1 | 7/2007 |
| EP | 1 836 935 | A1 | 9/2007 |
| EP | 1 854 378 | A1 | 11/2007 |
| EP | 1 232 703 | B1 | 2/2008 |
| EP | 1 886 798 | A2 | 2/2008 |
| EP | 1 911 374 | A1 | 6/2008 |
| EP | 2 047 769 | A1 | 4/2009 |
| EP | 2 070 443 | A1 | 6/2009 |
| EP | 2 100 539 | A1 | 9/2009 |
| EP | 2 110 050 | A1 | 10/2009 |
| EP | 2 110 051 | A1 | 10/2009 |
| EP | 2 110 052 | A1 | 10/2009 |
| EP | 2 005 861 | B1 | 4/2011 |
| EP | 2 070 446 | A1 | 5/2011 |
| EP | 2 319 967 | A1 | 5/2011 |
| EP | 2 335 527 | A1 | 6/2011 |
| EP | 2 520 199 | A1 | 11/2012 |
| EP | 2698 081 | A1 | 2/2014 |
| EP | 2 724 641 | A1 | 4/2014 |
| EP | 2 765 026 | A1 | 8/2014 |
| EP | 3 409 144 | A1 | 12/2018 |
| FR | 820791 | | 11/1937 |
| FR | 1383559 | | 11/1964 |
| FR | 1518777 | | 2/1968 |
| FR | 1 531 798 | A | 7/1968 |
| FR | 2 045 120 | | 2/1971 |
| FR | 2 233 799 | A | 6/1973 |
| FR | 2 461 472 | A1 | 2/1981 |
| FR | 2 533 428 | A1 | 3/1984 |
| FR | 2533428 | | 3/1984 |
| GB | 469313 | | 7/1937 |
| GB | 608327 | | 9/1948 |
| GB | 610741 | | 10/1948 |
| GB | 770169 | | 3/1957 |
| GB | 2 028 119 | A | 3/1980 |
| GB | 1568368 | | 5/1980 |
| GB | 2 092 438 | A | 8/1982 |
| JP | 3-15411 | A | 1/1991 |
| JP | H 0889359 | A | 4/1996 |
| JP | 2713169 | | 10/1997 |
| JP | 2001-78852 | A | 3/2001 |
| JP | 2002-172036 | A | 6/2002 |
| JP | 2004 04 9658 | A1 | 2/2004 |
| JP | 2005-211250 | A | 8/2005 |
| JP | 3874392 | | 11/2006 |
| JP | 4176462 | B2 | 11/2008 |
| JP | 2009-268780 | A | 11/2009 |
| JP | 2010-063821 | A | 3/2010 |
| JP | 2010-063831 | A | 3/2010 |
| JP | 2010-82021 | A | 4/2010 |
| JP | 2010-94301 | A | 4/2010 |
| JP | 4491318 | B2 | 6/2010 |
| JP | 4704892 | B2 | 6/2011 |
| JP | 4718975 | B2 | 7/2011 |
| JP | 4932983 | B2 | 5/2012 |
| JP | 5007444 | B2 | 8/2012 |
| JP | 5290695 | B2 | 6/2013 |
| JP | 2013-132402 | A | 7/2013 |
| JP | 2013-132403 | | 7/2013 |
| JP | 2013-132403 | A | 7/2013 |
| JP | 2013-151252 | A | 8/2013 |
| JP | 2015 123321 | A | 7/2015 |
| JP | 2015 177979 | A | 10/2015 |
| JP | 5881239 | B2 | 3/2016 |
| JP | 6015070 | B2 | 10/2016 |
| JP | 6537827 | B2 | 7/2019 |
| JP | 6538020 | B2 | 7/2019 |
| KR | 2006-0087336 | | 8/2006 |
| NL | 7804978 | | 5/1978 |
| WO | WO 89/03648 | A1 | 5/1989 |
| WO | WO 92/20262 | A1 | 11/1992 |
| WO | WO 99/34710 | A1 | 7/1999 |
| WO | WO 00/74531 | A1 | 12/2000 |
| WO | WO 01/76418 | A1 | 10/2001 |
| WO | WO 01/91614 | A1 | 12/2001 |
| WO | WO 02/058514 | A1 | 8/2002 |
| WO | WO 02/091880 | A1 | 11/2002 |
| WO | WO 2003/068025 | A3 | 8/2003 |
| WO | WO 2004/103121 | A1 | 12/2004 |
| WO | WO 2005/025379 | A1 | 3/2005 |
| WO | WO 2007/012418 | A1 | 2/2007 |
| WO | WO 2007/095960 | A1 | 8/2007 |
| WO | WO 2007/110732 | A1 | 10/2007 |
| WO | WO 2007/112236 | A1 | 10/2007 |
| WO | WO 2008/000295 | A1 | 1/2008 |
| WO | WO 2008/092562 | A1 | 8/2008 |
| WO | WO 2008/146887 | A1 | 12/2008 |
| WO | WO 2008/149224 | A1 | 12/2008 |
| WO | WO 2009/033535 | A1 | 3/2009 |
| WO | WO 2009/039231 | A1 | 3/2009 |
| WO | WO 2009/134451 | A1 | 11/2009 |
| WO | WO 2009/153811 | A1 | 12/2009 |
| WO | WO 2010/041894 | A2 | 4/2010 |
| WO | WO 2010/050204 | A1 | 6/2010 |
| WO | WO 2011/157392 | A1 | 12/2011 |
| WO | WO 2013/020088 | A2 | 2/2013 |
| WO | WO 2013/083562 | A1 | 6/2013 |
| WO | WO 2014/061732 | A1 | 4/2014 |
| WO | WO 2014/121923 | A1 | 8/2014 |
| WO | WO 2016/124328 | A1 | 8/2016 |
| WO | WO 2017/082316 | A1 | 5/2017 |
| WO | WO 2017/162310 | A1 | 9/2017 |
| WO | WO 2017/214564 | A1 | 12/2017 |

OTHER PUBLICATIONS

Steelcase brochure titled "Love how you work", dated 2008, 8 pgs.

Steelcase Please Chair with grey frame, obtained on the Internet at: https://2ndhnd, — 2ndndn.com.com/products,steelcase-please-chair-with-grey-frame, dated Jun. 9, 2016, 4 pgs.

Adsausage Knoll the Different Executive Chair, obtained on the Internet at: http://www.adsausage.com/ad.cfm?id-50669, dated Jun. 9, 2006, 2 pgs.

Dauphin furniture brochure for Lordo chairs, located on the Internet at: www.dauhin.com, 6 pgs.

Herman Miller, Ergonomic Chairs, obtained from the Internet at: http://decobizz.com/ergonomic-chairs-1454.html, dated Sep. 6, 2016, 2 pgs.

Different Smart Chair, obtained from the Internet at: http://humanscale.comproducts, 1 pg.

Knoll brochure titled "Generation by Knoll", 2009, 18 pgs.

Knoll brochure titled "ReGeneration by Knoll", 2012, 8 pgs.

Steelcase brochure, 2015, 8 pgs.

(56) References Cited

OTHER PUBLICATIONS

Sedus brochure, "se:motion, Office swivel chair for agile working", obtained from the Internet at: www.sedus.com, not dated, 20 pgs.
International Search Report and Written Opinion for PCT Application No. PCT/US2020/018785, dated Feb. 19, 2020, 14 pgs.

* cited by examiner

BODY SUPPORT ASSEMBLY AND METHOD FOR THE USE AND ASSEMBLY THEREOF

This application claims the benefit of U.S. Provisional Application No. 62/808,579, filed Feb. 21, 2019, and also claims the benefit of U.S. Provisional Application No. 62/947,914, filed Dec. 13, 2019, both of which are entitled "Body Support Assembly and Methods for the Use and Assembly Thereof," the entire disclosures of which are hereby incorporated herein by reference.

FIELD OF THE INVENTION

The present application relates generally to a body support assembly, for example a chair, and in particular to a backrest assembly and/or seat assembly incorporated into the body support assembly, and various components incorporated therein, together with methods for the use and assembly thereof.

BACKGROUND

Chairs, and in particular office chairs, may have a body support member configured with a suspension material, such as a mesh fabric, that is stretched across a frame. Such suspension materials conform to the body of the user, providing micro compliance along with improved air circulation, and the attendant cooling benefit. Typically, the frame must be rigid in order to maintain an appropriate level of tension in the suspension material. Such rigidity may limit, however, the flexibility of the body support member, and introduce unforgiving pressure points around the perimeter of the frame. In addition, suspension materials installed on a seat of a chair are typically required to sustain higher tensions due to the load being applied thereto by a seated user, which may exacerbate the limited flexibility and rigidity of the supporting structure.

While various mechanical systems, such as lumbar supports and tilt control mechanisms, may be introduced to mitigate the limited flexibility and provide additional adjustment capabilities, such systems are relatively expensive to manufacture, require additional maintenance, are susceptible to wear and tear over time, and may not be appropriately exploited by the user due to the requirement for individual adjustments. In addition, such tilt mechanisms typically include one or more rigid links, and mechanical connections, which are rigid and non-compliant, which result in a more rigid and less forgiving ride, and which may lead to a less desirable user experience. Conversely, systems relying on the materiality of the seating structure to introduce the appropriate kinematics and flexibility may not be suitable to support a suspension material. While body support surfaces may be defined by one or more foam cushions, foam materials may limit air circulation and often do not provide localized support. In addition, body support members configured with plastic shells, supported for example by peripheral frames, typically do not provide a comfortable body-conforming support surface.

SUMMARY

The present invention is defined by the following claims, and nothing in this section should be considered to be a limitation on those claims.

In one aspect, one embodiment of a seat assembly includes a lower support platform having a first peripheral edge, an upper surface and a lower surface. A support ring is coupled to the first peripheral edge of the lower support platform and extends radially outwardly therefrom and defines a second peripheral edge. The support ring includes an upper surface. An upper shell is disposed over the upper surfaces of the lower support platform and the support ring and defines a concave cavity. The upper shell has a third peripheral edge defining a central opening and an upper surface. A suspension material is secured to the upper shell across the central opening and covers the concave cavity.

In another aspect, one embodiment of a body support member includes a carrier frame having a body facing first surface, a second surface opposite the first surface, a peripheral edge surface extending between the first and second surfaces, and a peripheral groove formed in and opening outwardly from the peripheral edge surface. A support frame includes a first surface and a peripheral edge. A flexible edge member is connected to the peripheral edge of the support frame. The flexible edge member has an inner surface spaced apart from and facing the peripheral edge surface of the carrier frame. The inner surface and the peripheral edge surface define a gap therebetween, with the gap being in communication with the peripheral groove. A textile material includes a peripheral edge. The textile material covers the first surface of the carrier frame and is disposed in the gap between the inner surface of the flexible edge and the peripheral edge surface of the carrier frame. The textile material engages at least a portion of the peripheral edge surface of the carrier frame. The peripheral edge of the textile material is disposed in the peripheral groove.

In another aspect, one embodiment of a method of manufacturing a body support member includes disposing a peripheral edge of a textile material into a groove formed in a peripheral edge surface of a carrier frame, covering at least a portion of the peripheral edge surface and a body-facing first surface of the carrier frame with the textile material, and connecting a flexible edge member to the carrier frame. The flexible edge member has an inner surface spaced apart from and facing the peripheral edge surface of the carrier frame, wherein the inner surface and the peripheral edge surface define a gap therebetween, wherein the gap is in communication with the peripheral groove, and wherein the textile material is disposed in the gap.

In another aspect, one embodiment of a seat assembly includes a lower support platform extending in a longitudinal direction. The lower support platform includes opposite side edges and a laterally extending first flex region extending between the opposite side edges that bifurcates the lower support platform into a front portion and a rear portion. The first flex region is bendable such that the rear portion is downwardly deflectable relative to the front portion, even though both the front and rear portions may move upwardly during recline in one embodiment. An upper shell includes opposite side members connected to the support platform with a pair of connectors. Each of the connectors includes a second flex region, wherein the second flex regions are bendable such that the opposite side members are upwardly moveable relative to the lower support platform as the rear portion is downwardly deflectable.

In another aspect, a body support member includes a carrier frame having a central portion and a peripheral ring connected to the central portion with a plurality of connectors each having a flex region, with the peripheral ring defining a central opening. An elastic textile material is coupled to the peripheral ring across the central opening. A cushion is disposed between the central portion and the textile material. At least one the plurality of connectors is inwardly deflectable a first amount from a first unloaded configuration to a first loaded configuration in response to a load applied to the elastic material, and the elastic material is downwardly deflectable a second amount from a second unloaded configuration to a second loaded configuration in response to the load applied thereto. The cushion engages and provides auxiliary support to the elastic material when the first and second amounts of deflection result in the elastic material contacting the cushion.

In another aspect, one embodiment of a body support member includes a flexible carrier frame deformable from an unloaded configuration to loaded configuration, an elastic textile material coupled to the carrier frame, and a cushion disposed beneath the textile material. The flexible carrier frame, elastic material and cushion provide first, second and third amounts of resilient support to a user engaging and supported by the textile material.

In another aspect, one embodiment of a body support member includes a carrier frame having opposite side portions defining an opening therebetween. An elastic textile material is coupled to the side portions across the opening, with a cushion disposed beneath the textile material. At least one of the side portions, and preferably both side portions, are inwardly deflectable a first amount from a first unloaded configuration to a first loaded configuration in response to a load applied to the elastic material. The elastic material is downwardly deflectable a second amount from a second unloaded configuration to a second loaded configuration in response to the load applied thereto, and the cushion engages and provides auxiliary support to the elastic material when the first and second amounts of deflection result in the elastic material contacting the cushion.

In another aspect, one embodiment of a body support assembly includes a seat having opposite sides spaced apart in a lateral direction and a front and rear spaced apart in a first longitudinal direction.

Various methods of using and assembling the body support assembly and other components are also provided.

The various embodiments of the body support assembly and components, and methods for the use and assembly thereof, provide significant advantages over other body support assemblies and methods. For example and without limitation, the structure allows for the integration of a suspension material into the backrest and/or seat, while maintaining an overall flexibility of those components. The structure and user interface provide a body support structure that adapts to the user's body and provides for macro compliance during use, while also providing micro compliance at the user interface and avoiding hard interfaces around the periphery thereof.

In addition, the various links and flex regions provide a simple but robust structure that ensures a proper fit for a multitude of users without the requirement of complex mechanical mechanisms and adjustment interfaces. The body support assemblies, with their various flex regions and material compliance, provide for improved comfort and fit, while reducing costs by reducing and/or eliminating the overall number of parts, including various metal components, which may reduce manufacturing costs. In addition, the compliant materials may reduce the overall weight of the body support assembly, and the attendant shipping costs associated therewith. The body support assembly is uncomplicated, durable, visually appealing and capable of a long operating life.

The foregoing paragraphs have been provided by way of general introduction, and are not intended to limit the scope of the claims presented below. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
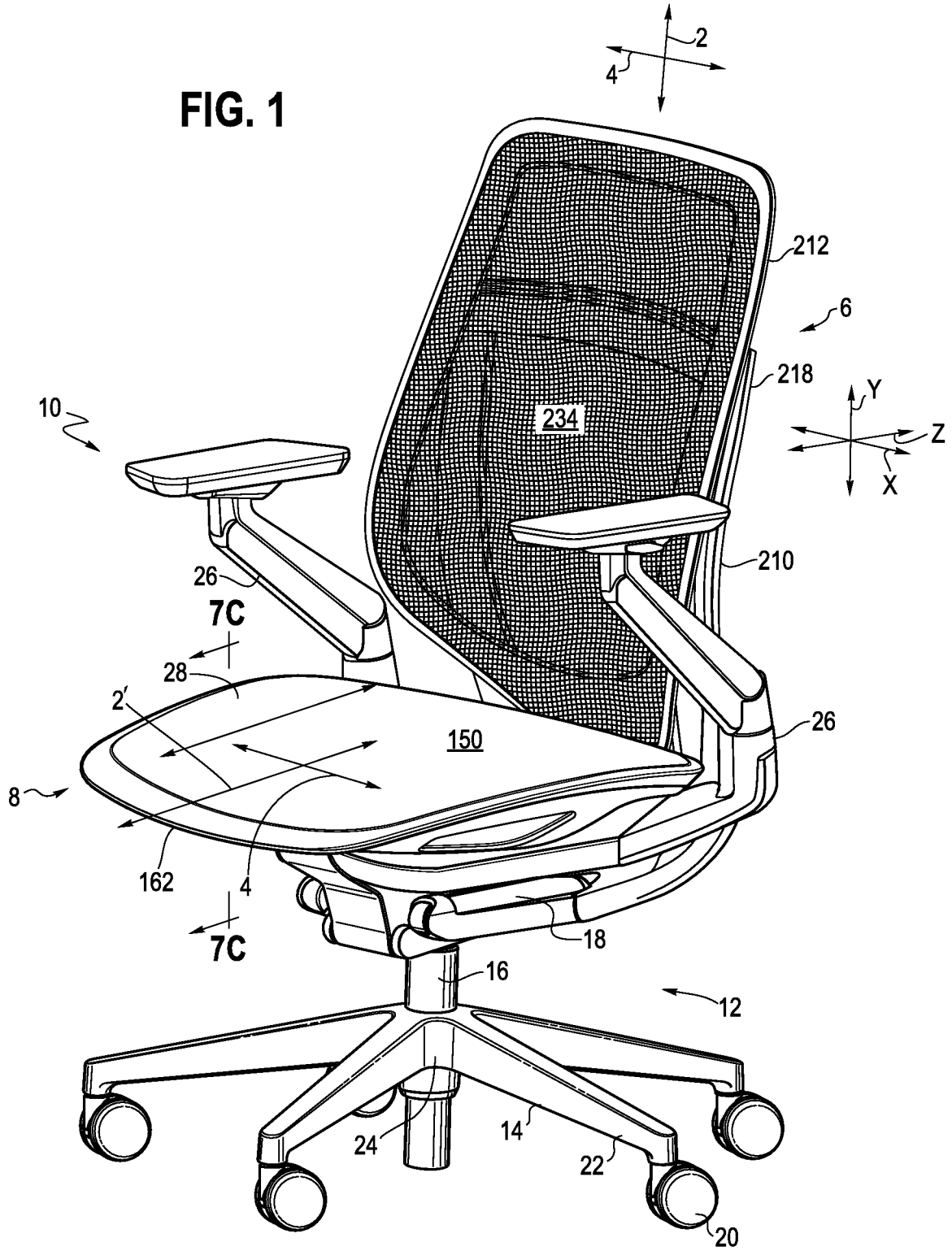
FIG. 1 is a perspective view of one embodiment of a body support assembly.
Figure 2:
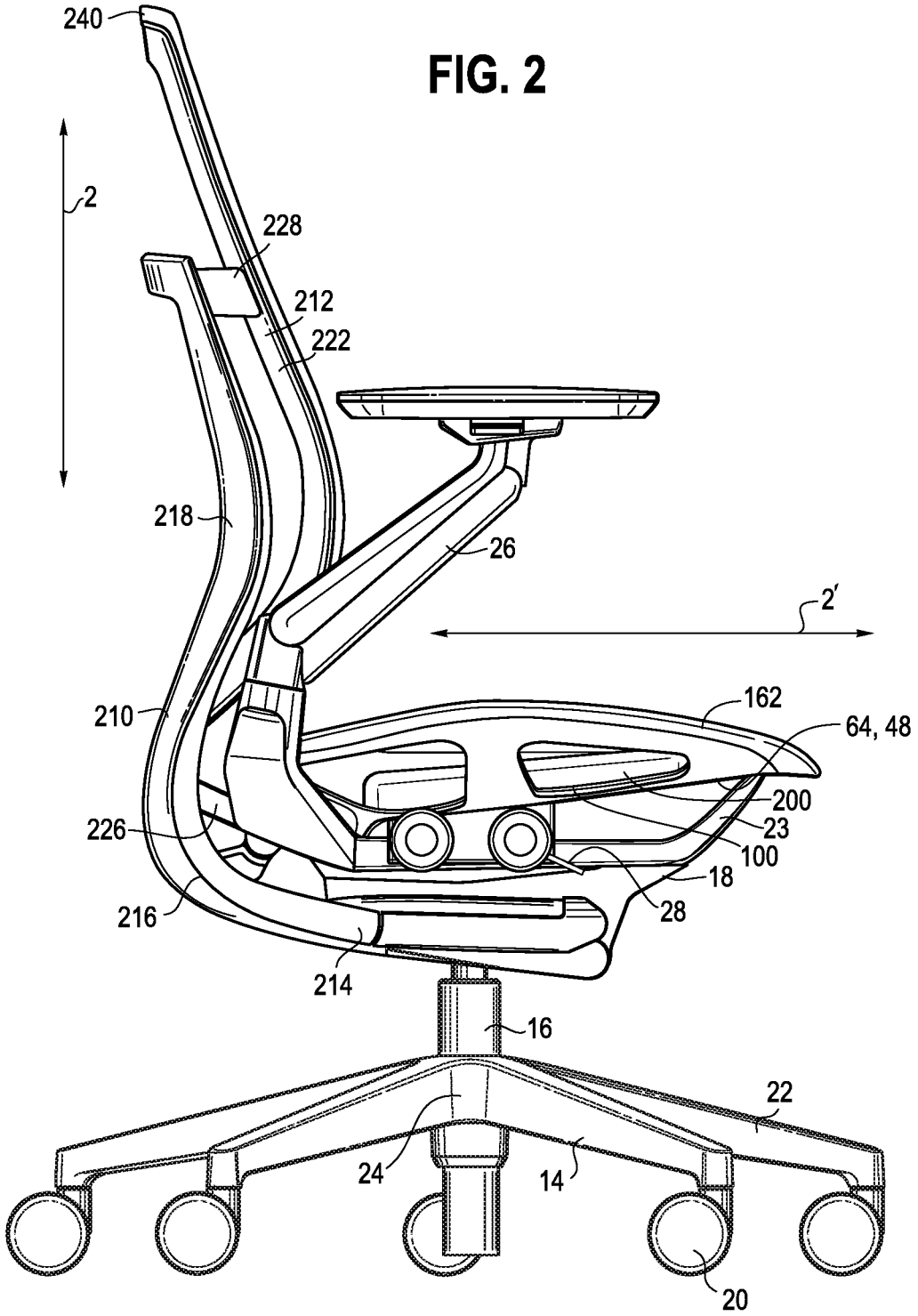
FIG. 2 is a right side view of the body support assembly shown in FIG. 1, with the left side view being a mirror image thereof.
Figure 3:
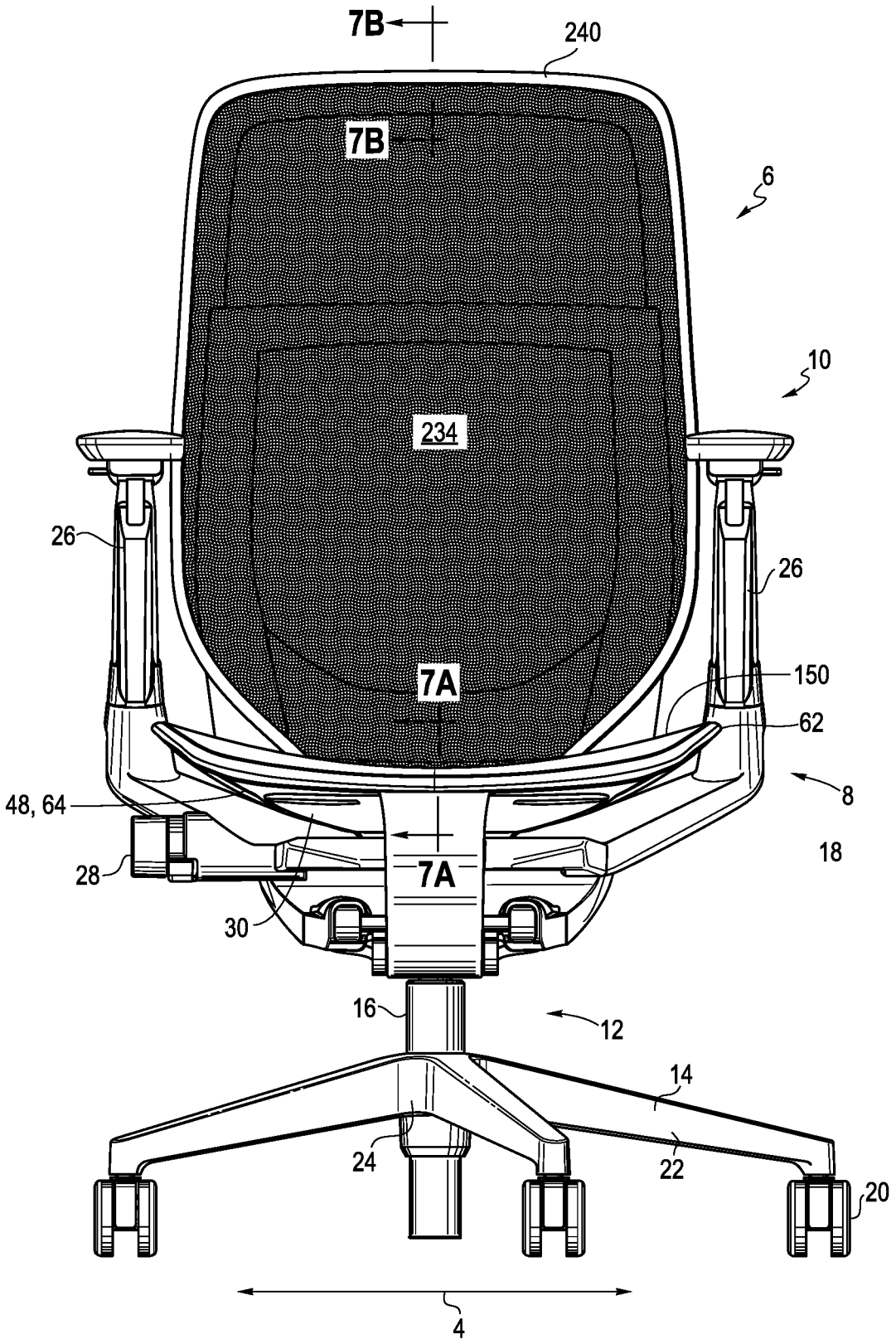
FIG. 3 is front view of the body support assembly shown in FIG. 1.
Figure 4:
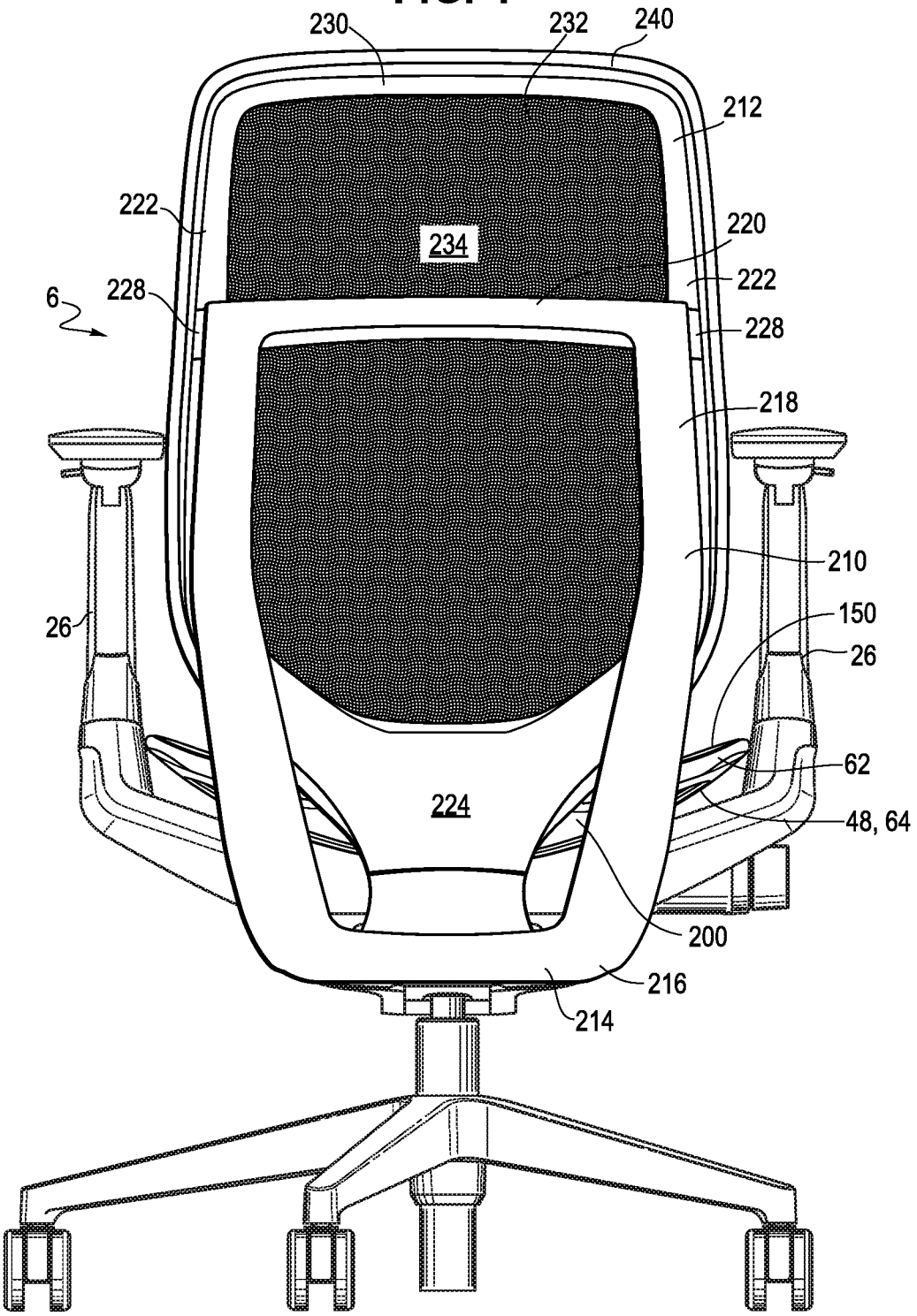
FIG. 4 is a rear view of the body support assembly shown in FIG. 1.
Figure 5:
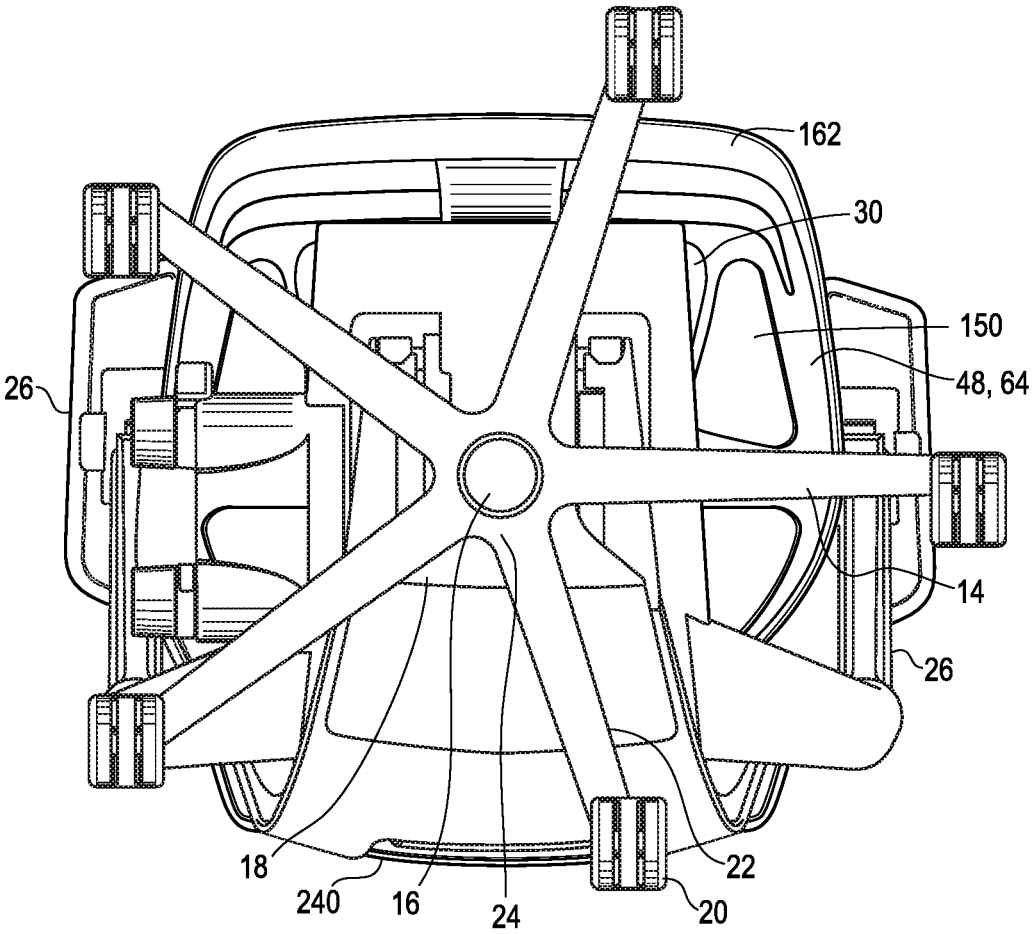
FIG. 5 is a bottom view of the body support assembly shown in FIG. 1.
Figure 6:
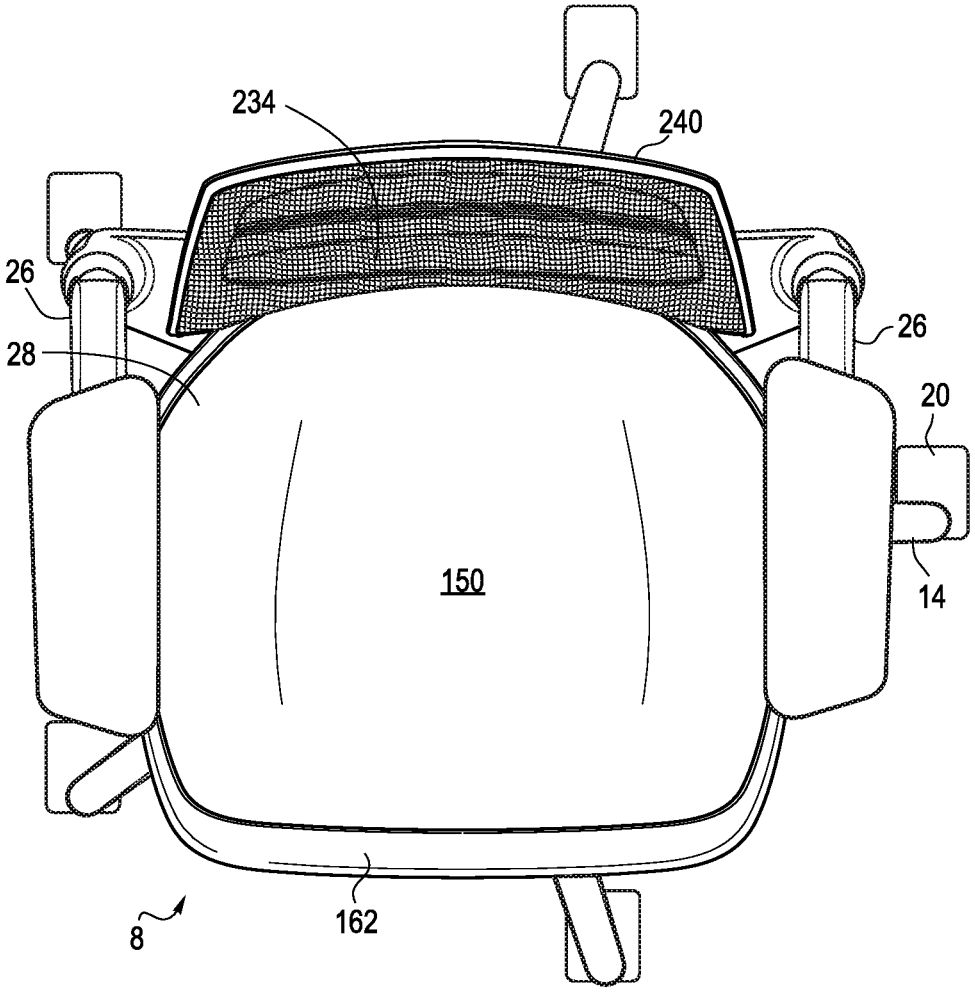
FIG. 6 is a top view of the body support assembly shown in FIG. 1.

It should be understood that the term "plurality," as used herein, means two or more. The term "longitudinal," as used herein means of or relating to a length or lengthwise direction 2, 2', for example a direction running from the bottom of a backrest assembly 6 to the top thereof, or vice versa, or from the front of a seat assembly 8 to the rear thereof, or vice versa. The term "lateral," as used herein, means situated on, directed toward or running in a side-to-side direction 4 of a body support assembly 10, shown in one embodiment as an office chair including the backrest assembly 6 and seat assembly 8. It should be understood that the body support assembly may be configured as any structure that supports a body, including without limitation automotive, aircraft and mass-transit seating, beds, home furnishings (including sofas and chairs), and other similar and suitable structures. In one embodiment of a backrest assembly disclosed below, a lateral direction 4 corresponds to a horizontal direction and a longitudinal direction 2 corresponds to a vertical direction, while in one embodiment of a seat assembly, the longitudinal direction 2' corresponds to a horizontal direction. The lateral direction 4 may be referred to as an X direction, while the longitudinal direction 2, 2' refers to a Y direction and a Z direction is orthogonal to the body support surface of both the backrest and seat assemblies 6, 8.

The term "coupled" means connected to or engaged with, whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components. The terms "upper," "lower," "rear," "front," "fore," "aft," "vertical," "horizontal," "right," "left," and variations or derivatives thereof, refer to the orientations of an exemplary body support assembly 10, shown as a chair in FIGS. 1-6, from the perspective of a user seated therein. The term "transverse" means non-parallel. The term "outwardly" refers to a direction facing away from a centralized location, for example the phrase "radially outwardly" refers to a feature diverging away from a centralized location, for example the middle or interior region of a seat or backrest, and lies generally in the X Y plane defined by the lateral and longitudinal directions 2, 2', 4. It should be understood that features or components facing or extending "outwardly" do not necessarily originate from the same centralized point, but rather generally emanate outwardly and exteriorly along a non-tangential vector. Conversely, the term "inwardly" refers to a direction facing toward the centralized or interior location.

The term "textile material" refers to a flexible material made of a network of natural or artificial fibers (yarn, monofilaments, thread, etc.). Textile materials may be formed by weaving, knitting, crocheting, knotting, felting, or braiding. Textile materials may include various furniture upholstery materials, which may be used for example to cover a foam cushion, and/or suspension materials, which may be stretched or put in tension across an opening to support a user.

Body Support Assembly:

Referring to FIGS. 1-6, the body support assembly 10 is shown as including a tilt control assembly 18, also referred to as a lower support structure, a base structure 12 and the backrest and seat assemblies 6, 8. In one embodiment, the base structure 12 includes a leg assembly 14 and a support column 16 coupled to and extending upwardly from the leg assembly. The tilt control assembly 18 is supported by and coupled to a top of the support column 16. The leg assembly may alternatively be configured as a fixed structure, for example a four legged base, a sled base or other configuration. In one embodiment, the support column 16 may be height adjustable, including for example and without limitation a telescopic column with a pneumatic, hydraulic or electro-mechanical actuator. The leg assembly 14 includes a plurality of support legs 22 extending radially outwardly from a hub 24 surrounding the support column. Ends of each support leg may be outfitted with a caster, glide or other floor interface member 20.

In the embodiment of FIGS. 1-6, a pair of armrest assemblies 26 are coupled to the tilt control assembly 18. Various user interface controls 28 are provided to actuate and/or adjust the height of the seat, including for example an actuation lever pivotally coupled to the armrest assembly, or to control the tension and/or return force of the tilt control assembly 18.

Tilt Control Assembly:

Referring to FIGS. 1-6 and 28A-D, the backrest and seat assemblies 6, 8 are operably coupled to the tilt control assembly 18, or lower support structure, which controls the movement thereof, for example during recline. One embodiment of a suitable tilt control assembly is disclosed in U.S. Pat. No. 9,826,839, entitled "Chair Assembly with Upholstery Covering," the entire disclosure of which is hereby incorporated herein by reference. The tilt control assembly may include a plurality of rigid control links, which may be mechanically connected, for example via pivot pins, to form a linkage assembly, including for example a four-bar linkage.

In other embodiments, the tilt control assembly include integrally formed links 23, 25, 33, configured for example with strategic deformable locations that allow for predetermined deformations and define "flex regions," otherwise referred to as "flex joints," or virtual pivot locations. The various configurations of the links and flex regions may be configured as shown and disclosed in U.S. Pub. No. 2016/0296026 A1, entitled "Seating Arrangement," and in U.S. Pub. No. 2018/0352961, entitled "Seating Arrangement and Method of Construction," the entire disclosures of which are hereby incorporated herein by reference.

Figure 21:
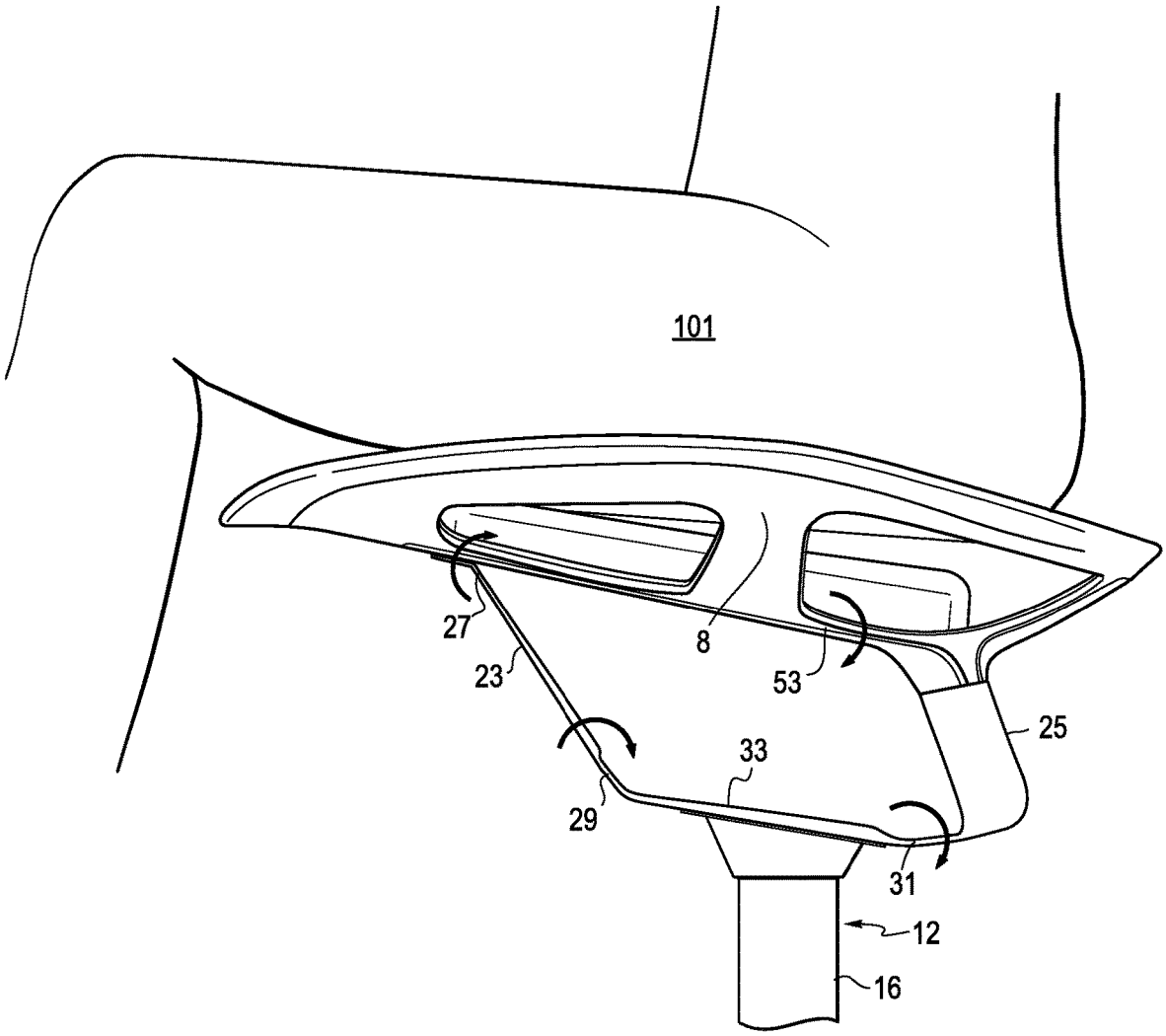
FIG. 21 is a schematic view showing a four-bar mechanism supporting a seat assembly.

For example, the tilt control assembly 18 may be configured as a four-bar mechanism as shown in FIG. 21, with a bottom, or base link 33 connected to the base structure 12 at a first location, and front and rear links 23, 25 connected between the base link and the seat assembly 8. The base, front and rear links 33, 23, 25 define the lower support structure. For example, the front and rear links 23, 25 may be pivotally or bendably connected to the base link 33 at flex regions 29, 31, whether integrally formed or otherwise. The front and rear links 23, 25 may also be pivotally, or bendably connected to the seat assembly 8 at flex regions 27, 53, with the portion 57 of the seat assembly extending between the flex regions 27, 53 defining a link of the four-bar mechanism. The flex region 53 is formed in the support platform 30 portion of the seat assembly. The various flex regions 27, 29, 31, 53 may be formed as living hinges, or thin flexible hinges made from the same material as the two more rigid pieces the living hinge connects, so as provide for relative rotation or pivoting between the more rigid pieces by bending of the living hinge. It should be understood that in alternative embodiments, the links and bars of the mechanism may also be configured as rigid links and bars connected at fixed hinge points.

In operation, a user can move or recline the backrest and seat assemblies 6, 8 from an upright position to a reclined position by flexing the four bar mechanism, including portions of the seat assembly. It is contemplated that the four-bar linkage arrangement as used and described herein is inclusive of linkage arrangements comprising additional linkage members, such as five-bar linkage arrangements, six-bar linkage arrangements, and the like. In various embodiments, the thickness of one or more links 23, 25, 33, 57, and especially the front, base and seat links 23, 33, 57, and predetermined flex regions thereof, may be located to achieve a desired performance characteristic, including for example, the flexibility of the link. Further, in certain embodiments, the thickness of a link may vary along the length of the link to achieve a desired flexibility or rigidity across the link or in a localized portion of the link, for example at flex regions 27, 28, 31 and 53. In addition, and for example, the front links and seat assembly link may be more flexible than the rear link 25 to achieve the desired flexibility of the four-bar linkage. In some embodiments, the various links may be more flexible in a particular portion or localized area of the link such that the links are generally flexible in the localized area and are generally not flexible or less flexible in any other area of the link. It is noted that the relative areas of reduced thickness may extend along a short distance or the majority of the length of the associated link depending upon the support and bending characteristics desired.

Figure 13:
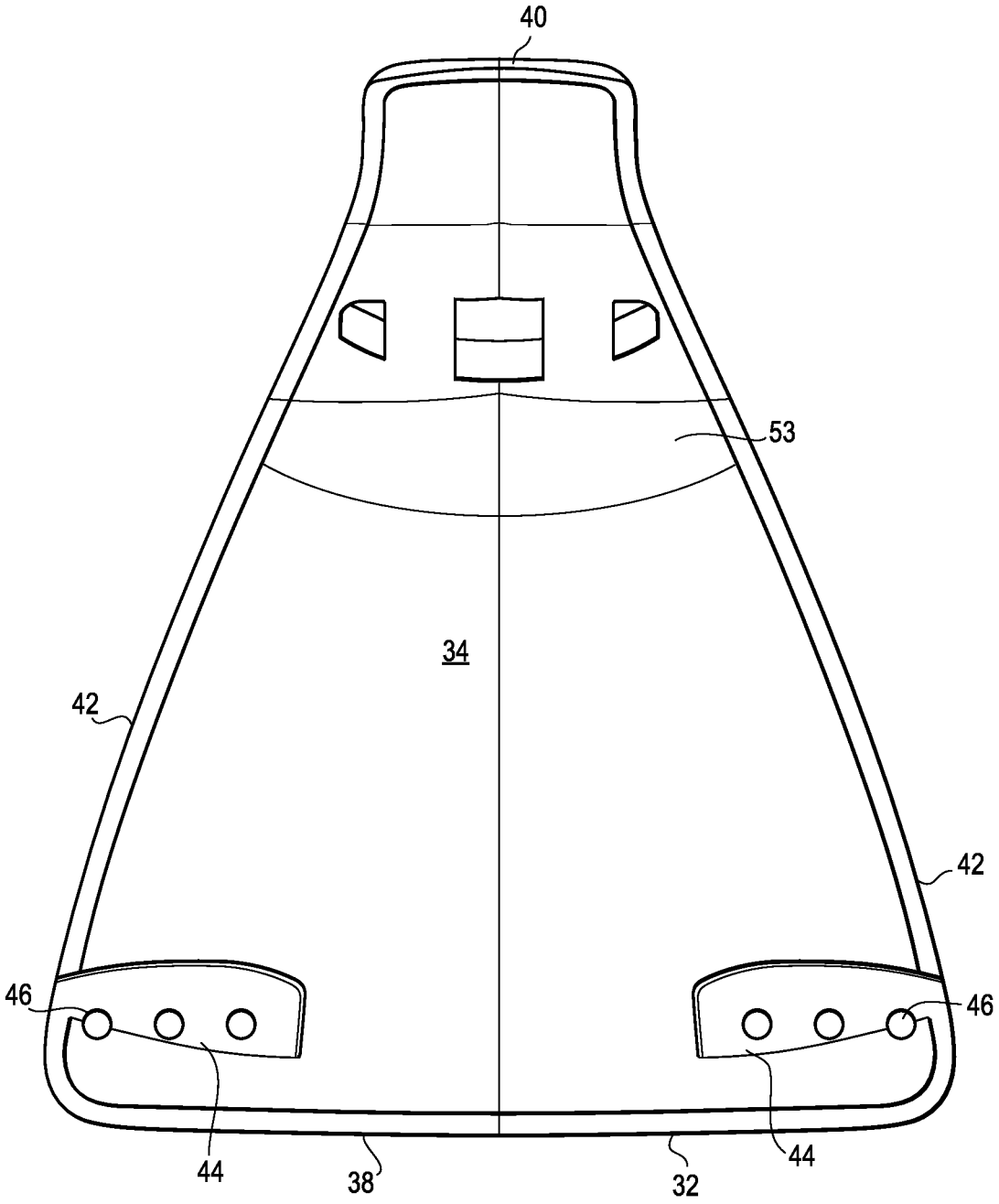
FIG. 13 is a top view of the support platform shown in FIG. 10.
Figure 14:
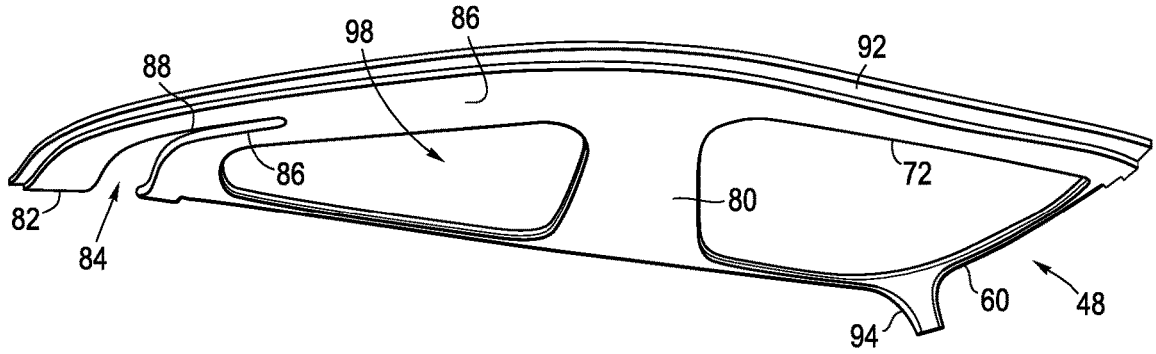
FIG. 14 is a left side view of one embodiment of a support ring, with a right side view being a mirror image thereof.
Figure 15:
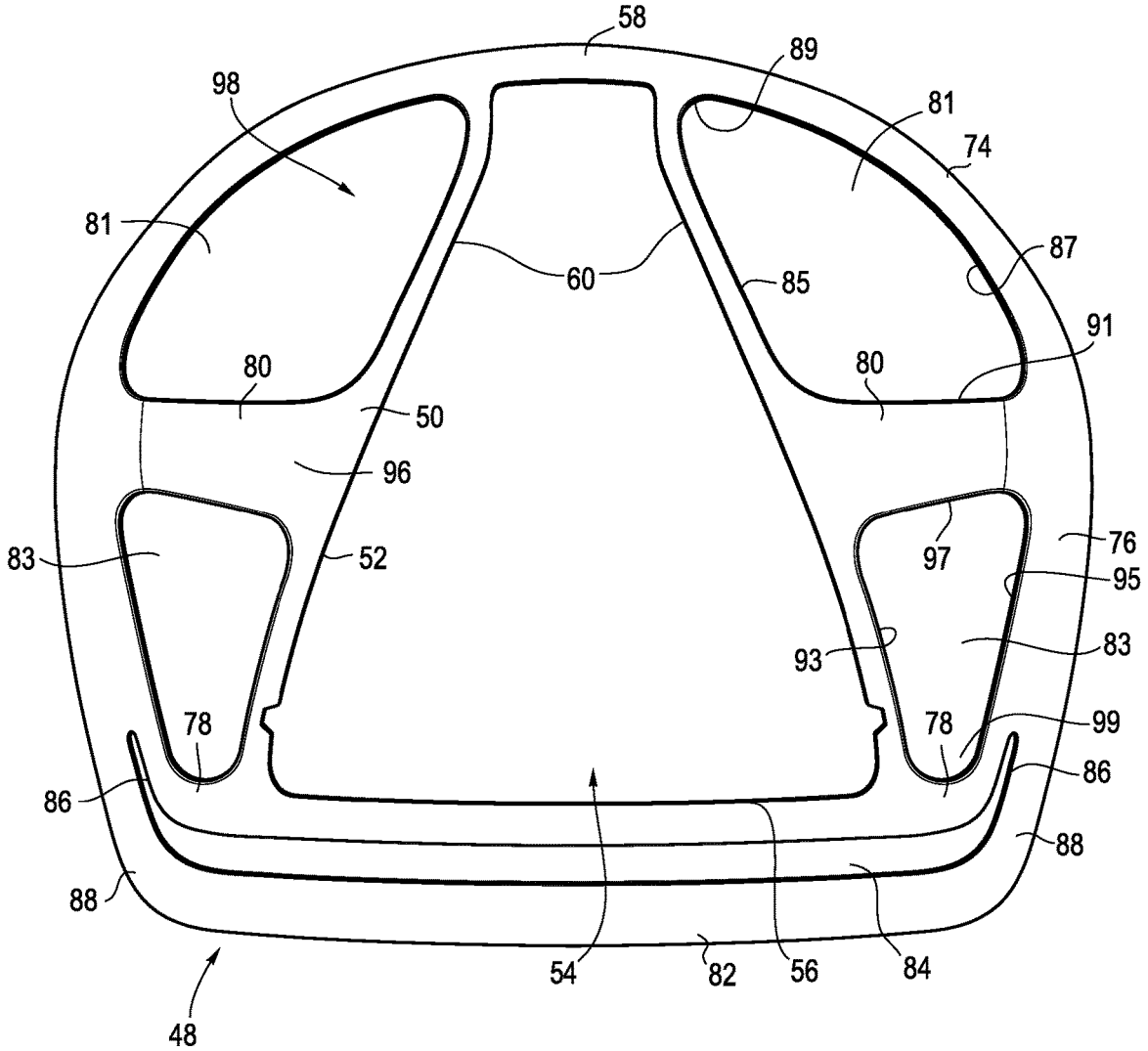
FIG. 15 is a top view of the support ring shown in FIG. 14.
Figure 16:
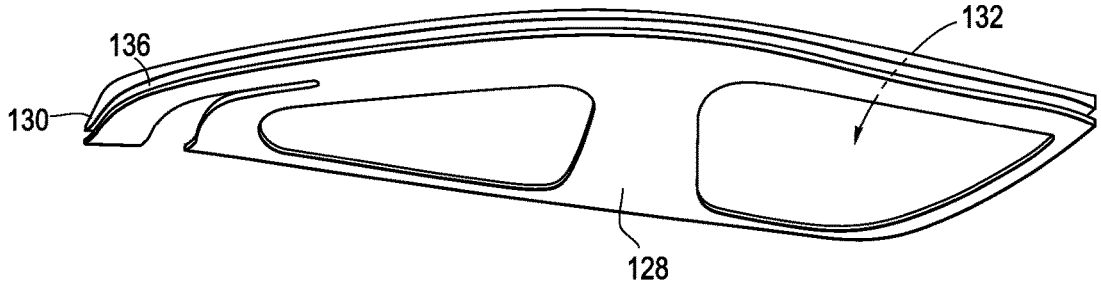
FIG. 16 is a side view of one embodiment of an upper seat shell.
Figure 17:
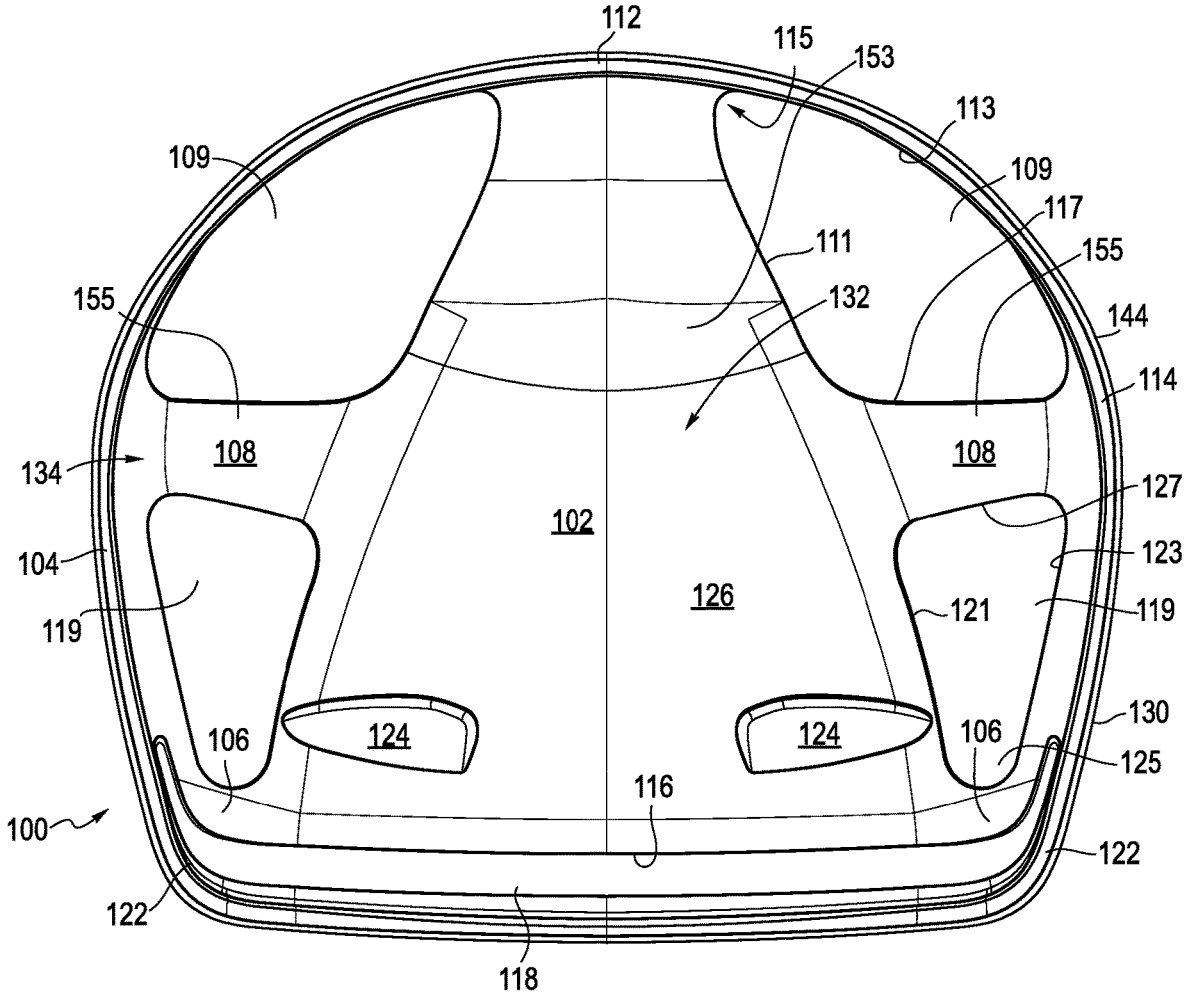
FIG. 17 is a top view of the upper shell shown in FIG. 16.

Seat Assembly:

Referring to FIGS. 1-7C, 8-25 and 28A-D, the seat assembly 8 is operably coupled to the tilt control assembly 18 and supports a seating surface 28. The seat has opposite sides spaced apart in a lateral direction and a front and rear spaced apart in a first longitudinal direction. The seat assembly includes a lower support platform 30 having a peripheral edge 32, an upper surface 34 and a lower surface 36. In one embodiment, the lower support platform has a generally isosceles trapezoidal shape in plan view (see FIG. 13) with a front edge 38, rear edge 40 and side edges 42 joining the front and rear edges. The rear edge is shorter than the front edge. The peripheral edge 32 may be stepped, meaning a peripheral edge portion 66 thereof is thinner than a central portion 68 thereof.

The support platform 30 has a pair of laterally spaced pads 44 positioned at a forward portion of the support platform. As shown in FIGS. 28A-D, the platform 30 includes a raised portion 970 defining a recess 974 and an opening 972. The pads are each defined as a hinge portion 976 with a front edge 978 secured to a front edge 980 of the platform defining the opening 972 in the platform. The hinge portion may be formed by overmolding a more flexible material to the support platform. The hinge portion 976 extends rearwardly in the opening with a rear edge 982 spaced apart from a rear edge 984 of the platform defining the opening 972. Each of the pads 44 includes at least one mounting component, shown as openings 46 shaped and dimensioned to receive mounting members (e.g. fasteners or studs 988) for securing the platform to the tilt control assembly, which may include a flange 990 extending forwardly from the link 23 to support the platforms. The flange 990 is received in the recess 972 and includes bosses extending upwardly into the openings 46 such that the flange 990 may be secured to a bottom surface of the pad, and hinge portion 976 in particular, with the plurality of fasteners 988. The flexible hinge portion 976 defines the flex region 27. The mounting component, and connection to the link 23, allows for pivoting of the support platform and the front link 23 relative to the base link 33 about a flex region 29, and for pivoting of the seat assembly 8 relative to the front link 23 about flex region 27, executed in both cases for example by elastic deformation or bending of portions of the front links at the flex regions 27, 29, or alternatively by bending or flexing of the pads or hinge portion 976. At the same time, the spacing between the pads, and front links, provides relative stability to the front portion of the seat, which resists rotation or torsional movement about a longitudinal axis. A boss structure 49 extends downwardly from a rear portion of the support platform. The boss structure 49 defines at least one mounting component that is connected to the tilt control assembly 18, and/or defines a portion of a rear link 25 forming in part the tilt control assembly and allows for pivoting of the support platform and the rear link 25 relative to the base link 33 about a flex region 31, which may be executed for example by elastic deformation or bending of portions of the base link 33 at flex region 31. In one embodiment, the boss structure 49 has a tubular configuration defining a cavity that surrounds or receives an insert portion of the rear link 25, configured with features from the connector 479, the 219. The centrally located rear link, which is the only support for the rear of the seat, allows for rotation or torsional movement of the rear of the seat relative to the front of the seat about a longitudinal axis, with the rotation or torsional movement of the front being restricted as previously explained. The support platform 30 has a generally concave upper surface 34, with front and rear portions 35, 37 extending upwardly from the boss structure.

The support platform may be made of a flexibly resilient polymer material such as any thermoplastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing the support platform to conform and move in response to forces exerted by a user. Other suitable materials may be also be utilized, such as metals, including, for example, steel or titanium; plywood; or composite material including plastics, resin-based composites, metals and/or plywood. The support platform may have strategically positioned tensile substrates, made for example of glass reinforced tape, to accommodate bending and deformation of the structure. Strategic locations on the lower support platform also are provided with specific geometries that allow for predetermined deformations and define "flex regions," otherwise referred to as "flex joints," or virtual pivot locations.

For example, the support platform may include an area of reduced thickness defining a laterally extending flex region or flexing zone 53 located in front of the boss structure 49, which divides or bifurcates the support platform into front and rear portions, which may have different lengths or dimensions, with the rear portion being downwardly deflectable relative to the front portion during recline as the flex region bends. The portion of the support platform extending between the flex region 53 and the flex region 27 defines a link of a four-bar mechanism, while a portion of the support platform rearward of the flex region 53 defines in part a portion of the rear link 25. It is noted that the relative areas of reduced thickness may extend along a short distance or the majority of the width of the support platform depending upon the support and bending characteristics desired. The phrase "flex region" refers to a portion of the structure that allows for flexing or bending in the designated region, thereby allowing or providing for relative movement (e.g., pivoting) of the component or structure on opposite sides of the flex region, thereby defining a virtual pivot location, for example a horizontal pivot axis, with the understanding that the virtual pivot axis may move during the flexing, rather than being defined as a hard fixed axis. The various configurations and materials of the support platform may correspond to the configuration and materials of various components as shown and disclosed in U.S. Pub. No. 2016/0296026 A1, entitled "Seating Arrangement," and in U.S. Pub. No. 2018/0352961, entitled "Seating Arrangement and Method of Construction," the entire disclosures of which are hereby incorporated herein by reference.

Figure 7A:
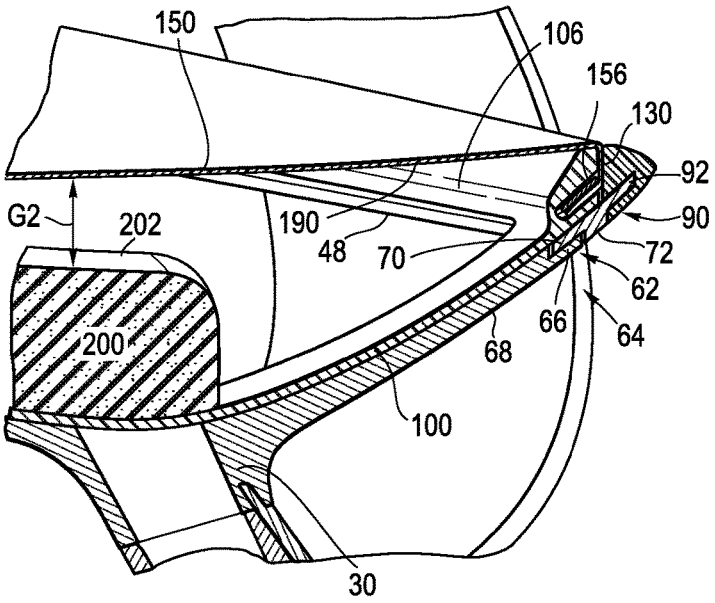
FIGS. 7A, B and C are partial cross-sectional views of a body support member.

A support ring 48 has an inner ring 50 with an interior peripheral edge 52 that defines a central opening 54. The interior peripheral edge 52 surrounds and is coupled to the outer peripheral edge 32 of the support platform, namely the rear edge 40, front edge 38 and side edges 42, of the support platform 30, which is received in the opening 54. The inner ring 50 has a trapezoidal shape defined by a front member 56, a rear member 58 and a pair of side members 60 defining the opening 54. The interior peripheral edge 52 may be stepped, meaning a peripheral edge portion 70 thereof is thinner than a central portion 72 thereof, with the edge portion 70 overlapping and mating with the edge portion 66 of the lower support platform. As shown in FIG. 7A, the edge portion 70 is positioned above the edge portion 66, with an upper surface of the peripheral edge 52 lying flush with the upper surface of the support platform 30. The edge portions 70, 66 may be secured with fasteners, such as screws and/or adhesive. It should be understood that the support platform 30 and support ring 48 in combination define a support frame 62.

In one embodiment, the support ring 48 further includes an outer ring 74 with side members 76 joined to side members 60 of the inner ring with a pair of front connectors 78 and a pair of intermediate connectors 80. A pair of rear three-sided openings 81 are defined between an inner edge of the outer ring 74, an edge of the side member and the edges of the connectors 80. The openings 81 each have an inner side 85, a longer, outer curved side 87, with the sides 87 and 85 converging along the rear of the opening 81 to define a nose 89, and a third side 91 extending along and defining the connector 80 and joining the sides 85, 87. A pair of front three-sided openings 83 are defined between an inner edge of the outer ring 74, an edge of the side member 60 and the edges of the connectors 80. The openings 83 each have an inner side 93, a longer, outer curved side 95, with the sides 93, 95 converging along the front of the opening 83 to define a nose 99, and a third side 97 extending along and defining the connector 80 and joining the sides 93, 95.

It should be understood that in one embodiment, the intermediate connectors 80 may be omitted. The outer ring has a front cross member 82 and a rear member 58, which it shares with the inner ring, and which are connected to the side members 76. The front cross member 82 is spaced apart from the front member 56, which define an elongated and laterally extending U-shaped opening 84 therebetween. A flexible membrane 55 covers the opening 84, is connected to the support ring around the perimeter of the opening, and maintains the spacing between the cross member 82 and front member 56 when the cross member 82 flexes relative to the front member 56, for example when undergoing a load applied by a user's thighs. The membrane 55 may also serve as a limiter by limiting the amount of deflection of the cross member 82 when the load is applied thereto. The membrane 55 may be made of urethane, and may be over molded on the support ring 48 to cover the opening 84. Side slots 86 allow for front portions 88 of the side members 76 to flex or bend such that the front member 82 may deflect when loaded by the user's legs, while the connectors 78, 80 provide greater rigidity to the outer ring 74. An outer peripheral edge 90 is stepped, meaning a peripheral edge portion 92 thereof is thinner than the central portion 72 thereof. A pair of lugs 94 extend downwardly from the inner ring and are disposed along the sides of the boss structure, where they are supported by the tilt control assembly 18. The support ring 48 extends radially outwardly from the lower support platform 30. The support ring, including the outer ring, the inner ring and connectors, defines an upper surface 96 and a concave cavity 98. The support ring 48 is made of a compliant flexible material, which is configured to position and hold the flexible edge member 162, described in more detail below. The support ring 48 is less stiff than the support platform, and has a modulus of elasticity that is less than a modulus of elasticity of the support platform. The support ring may be made, for example, of polyester urethane, or a thermoplastic polyester elastomer.

An upper shell, also referred to as a carrier frame 100, has a central portion 102 overlying the inner ring 52 of the support ring and the lower support platform 30, and an outer ring 104 overlying the outer ring 74 of the support ring and the upper surface 34 of the support platform. The outer ring 104 and central portion 102 of the upper shell are coupled with at least two connectors, including a pair of front connectors 106 and a pair of intermediate connectors 108, which are curved with an upwardly facing concave curvature such that is rigid and resists outward/downward deflection/deformation.

A pair of rear three-sided openings 109 are defined between an inner edge of the outer ring 104, an edge of the central portion 102 and the edges of the connectors 108. The openings 109 each have an inner side 111, a longer, outer curved side 113, with the sides 111, 113 converging along the rear of the opening 109 to define a nose 115, and a third side 117 extending along and defining the connector 108 and joining the sides 111, 113. A pair of front three-sided openings 119 are defined between an inner edge of the outer ring 104, an edge of the central portion 102 and the edges of the connectors 108. The openings 119 each have an inner side 121, a longer, outer curved side 123, with the sides 121, 123 converging along the front of the opening 119 to define a nose 125, and a third side 127 extending along and defining the connector 108 and joining the sides 121, 123.

The outer ring 104 has a front cross member 110 and a rear member 112 that are connected to side members 114. The outer ring has a peripheral length defined around the perimeter thereof, with the length being fixed or maintained as a relative constant during recline of the seat. In other words, in one embodiment, the outer ring 104, defined by the side members 114, front cross member 110 and rear member 112, does not elongate during recline, or does not undergo elastic deformation along a tangent or length thereof in response to tensile forces, although the outer ring 104 is capable of bending or flexing as described in more detail below. The front cross member 110 is spaced apart from a front edge 116 of the central portion 102, which define an elongated and laterally extending U-shaped opening 118 therebetween. Side slots 120 allow for front portions 122 of the side members 114 to flex or bend such that the front cross member 110 may deflect when loaded by the user's legs, while the connectors 106, 108 provide greater rigidity to the outer ring 104. The connectors 106, 108 overlie the connectors 78, 80, with openings 84 and 118, along with membrane 53, being aligned. The upper shell includes pads 124 that overlie the pads 46. The upper shell 100 is secured to the support platform with fasteners, including for example hooks and screws.

The upper shell, or carrier frame 100, is flexible, but stiffer than the support ring 48, and has a modulus of elasticity that is greater than the modulus of elasticity of the support ring, but the carrier frame is less stiff than, and has a modulus of elasticity less than a modulus of elasticity of the support platform 30. The upper shell, or carrier frame 100, may be made of a flexibly resilient polymer material such as any thermoplastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing the support platform to conform and move in response to forces exerted by a user. Other suitable materials may be also be utilized, such as metals, including, for example, steel or titanium; plywood; or composite material including plastics, resin-based composites, metals and/or plywood.

The intermediate connectors 108 of the upper shell 100 may include an area of reduced thickness defining flex regions or flexing zones 155. The upper shell 100 also may have an area of reduced thickness defining a flex region or flexing zone 153 that overlies the flex region 53 of the underlying support platform, located in front of the boss structure 48.

The upper shell, or carrier frame 100, has a body facing upper surface 126, a lower surface 128 opposite the upper surface 126 and a peripheral edge surface 130, or side edge face, extending between the first and second surfaces 126, 128. In one embodiment, the peripheral edge surface 130 is substantially planar and has a vertical orientation, although it should be understood that the edge surface may be curved, curvilinear, or non-planar, and/or may be oriented at angles other than a vertical plane. The carrier frame 100 defines a concave cavity 132 with the outer ring defining a central opening 134.

Figure 7B:
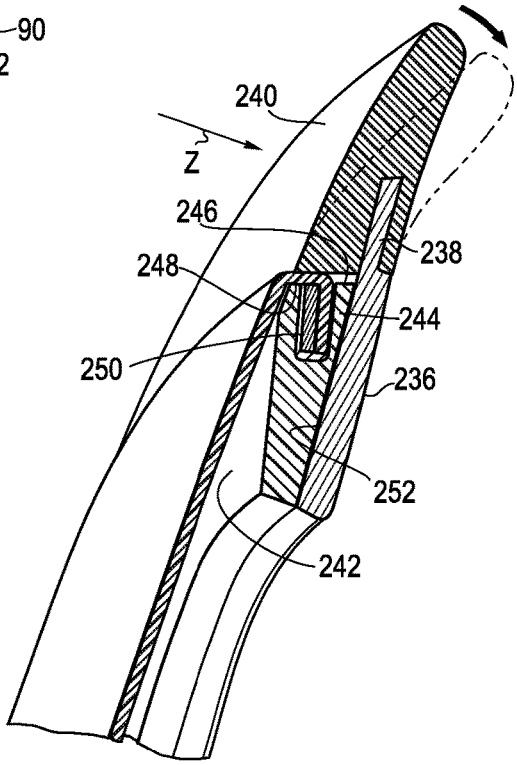
Figure 7C:
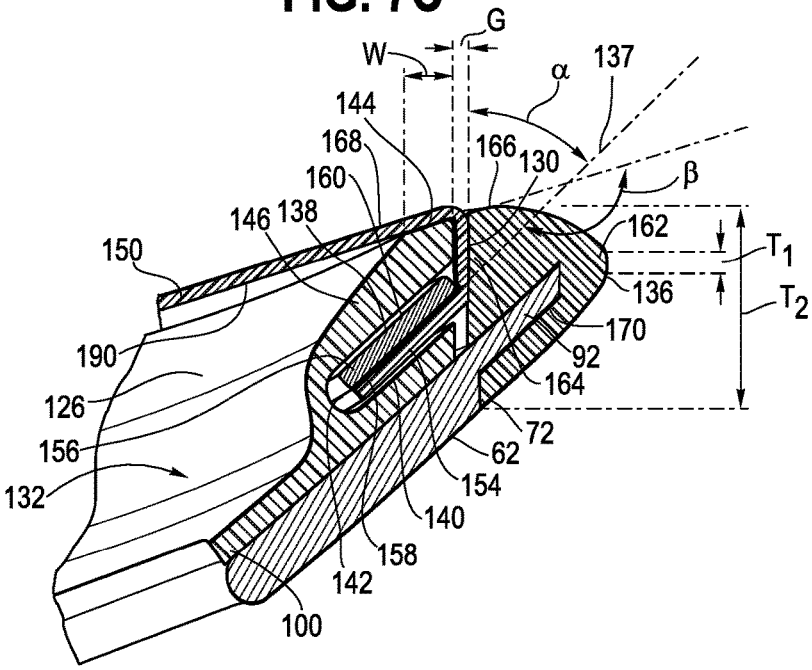
Figure 8:
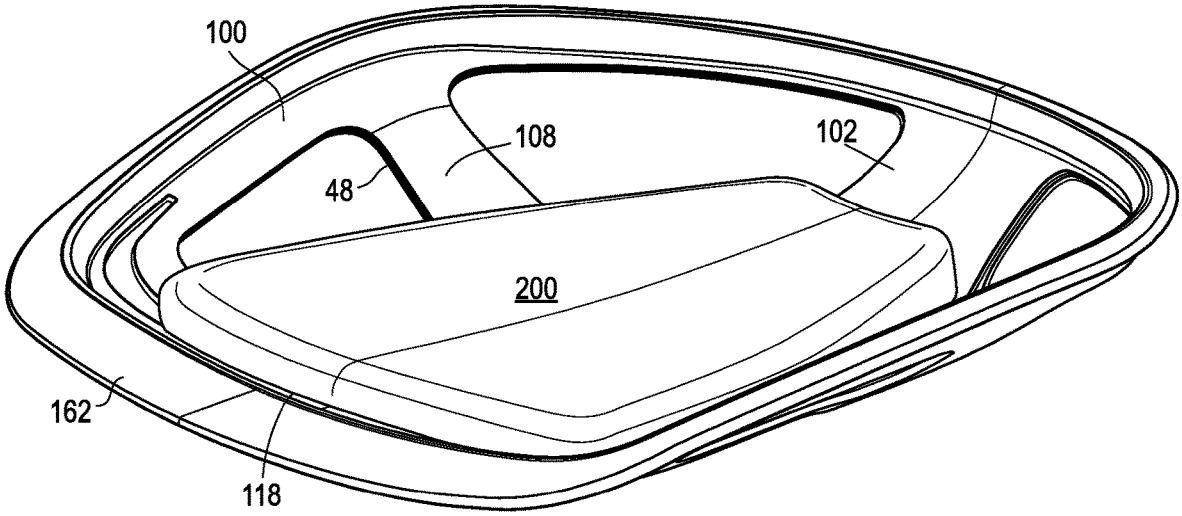
FIG. 8 is a partial perspective view of a seat without the textile material shown for the sake of illustrating the underlying components.
Figure 9:
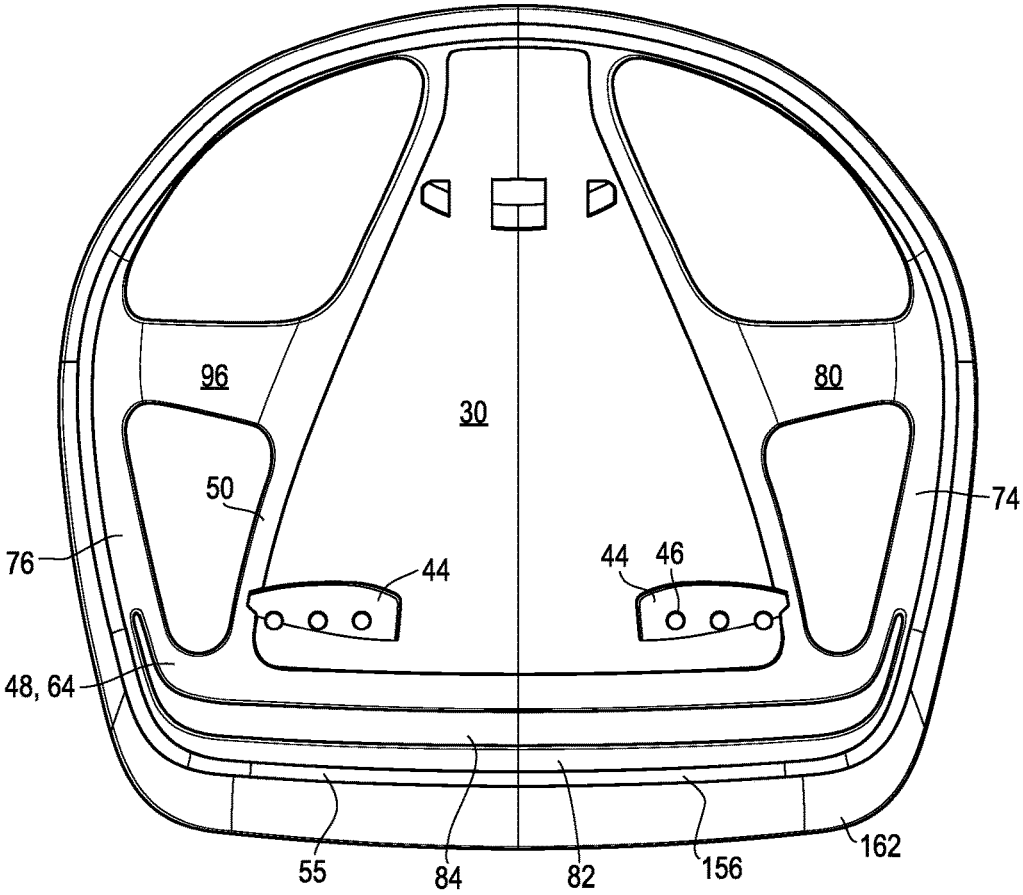
FIG. 9 is a top view of one embodiment of a seat support structure without the textile material or carrier frame shown for the sake of illustrating the underlying components.
Figure 10:
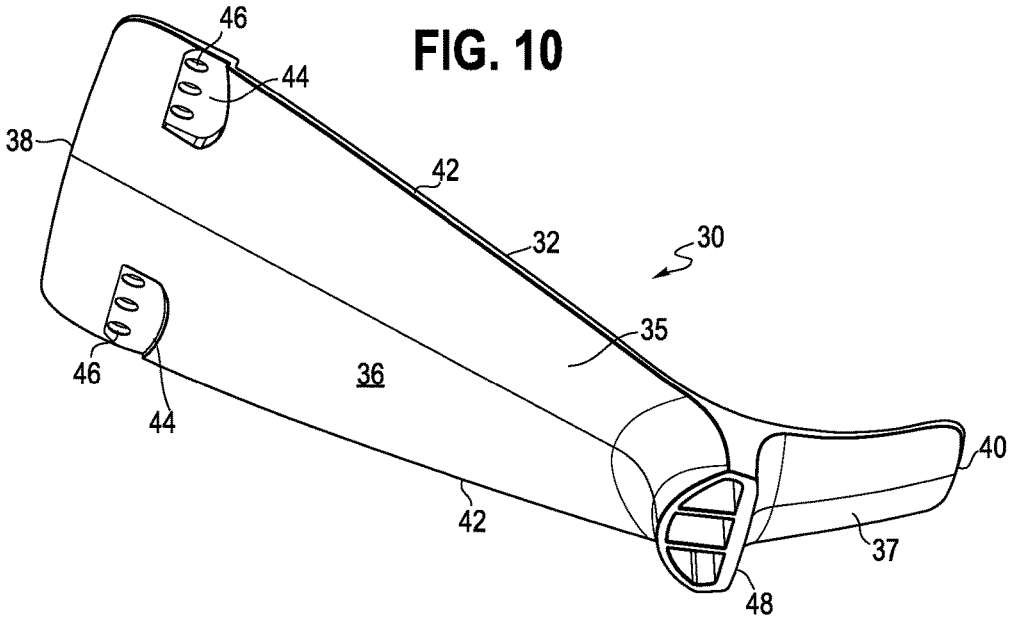
FIG. 10 is a bottom perspective view of one embodiment of a lower seat support platform.
Figure 11:
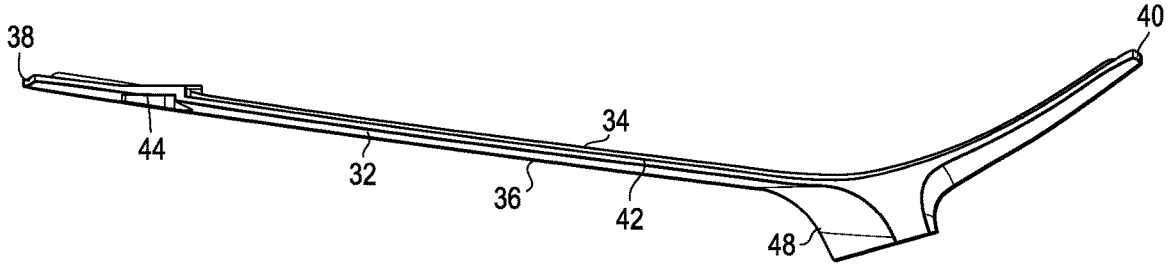
FIG. 11 is a right side view of the support platform shown in FIG. 10 with a left side view being a mirror image thereof.
Figure 12:
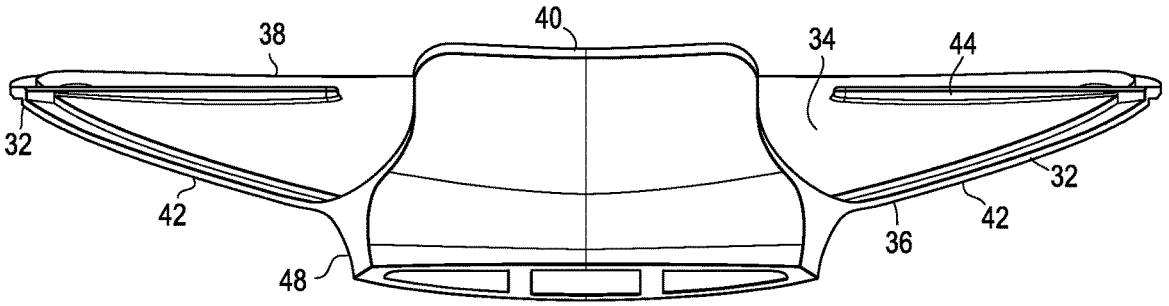
FIG. 12 is a rear view of the support platform shown in FIG. 10.

A peripheral groove 136 is formed in and opens outwardly from the peripheral edge surface 130 or face. The groove 136 extends around at least a portion of the carrier frame, and in one embodiment, extends continuously around the entire periphery of the carrier frame 100. The peripheral edge portion 92 of the support frame 62 extends outwardly beyond the face 130 of the carrier frame as shown in FIGS. 7A-C. The peripheral groove 136 defines an insertion plane 137 oriented at an angle $\alpha$ relative to the peripheral edge surface 130, and relative to a gap G adjacent thereto. In various embodiments, $\alpha$ is greater than 0 degrees and less than 180 degrees, and is preferably between 30 and 120 degrees, and more preferably between 45 and 90 degrees. Defined another way, the insertion plane 137 is preferably oriented relative to a landing portion 144, or tangent of a textile material 150 supported thereby, such that the insertion plane is parallel to the landing portion and tangent, or forms an angle $\beta$ that is preferably between 135 and 180 degrees. The peripheral groove 136 has a pair of spaced apart surfaces, e.g., upper and lower surfaces 138, 140, and a bottom 142 connecting the surfaces 138, 140. The upper surface 126 of the upper shell has a landing portion 144, which is substantially horizontal, and an angled portion 146 that extends away from the landing portion and defines the cavity. The landing portion 144 may have a width (W) approaching 0, with the landing portion defined simply by an upper corner of the edge surface 130.

A textile material 150 is secured to the carrier frame 100 across the central opening 134 such that it covers the concave cavity 132. The textile material may be a suspension material, or may cover a cushion supported by the support and/or carrier frames 64, 100. The textile material covers the upper surface 126 of the upper shell, and engages the landing portion 144. The textile material 150 wraps around and engages a portion of the outer peripheral edge surface 130, and in particular an upper portion 152 of the peripheral edge surface extending between the groove 136 and the upper surface 126, or landing portion 144 thereof. A peripheral edge portion 154 of the textile material 150 is coupled to the peripheral edge of the upper shell, for example with the edge portion 154 of the textile material being disposed in the groove 136. In one embodiment, a stay 156 (shown in FIG. 20 without the textile material), formed for example by a ring (e.g., a plastic or polyester), may be secured to the edge portion of the textile material, for example with adhesives, sewing/stitching, fasteners and other devices, or by forming a loop disposed around the stay. In one embodiment, the stay has one surface 158 facing and engaged with the textile material and an opposite surface 160 that remains uncovered. The stay 156 and edge portion 154 of the textile material, which is configured as a suspension material, are disposed in the groove 136 to secure the suspension material in tension across the opening. In one embodiment, the stay 156 is formed as a continuous ring having a fixed length, with the stay 156 being relatively inelastic and resistant to elongation along a length thereof, but which may be flexible and bendable so as to move with the side members 114 and outer ring 104 during recline of the seat. In one embodiment, as shown in FIGS. 7A-7C, the exposed or uncovered surface 160 of the stay 156 directly engages the surface 138 of the groove, without any textile material or other substrate disposed therebetween. The angular orientation of the groove 136 and stay 156 relative to the edge surface helps to ensure that the stay 156 does not become dislodged from the groove. In one embodiment, the stay 156 and textile material 150 are inserted into the groove 136 without any auxiliary fastening systems, such as adhesive or mechanical fasteners, but rather are engaged only by friction as the textile/suspension material is put in tension as explained hereinafter.

Figure 22:
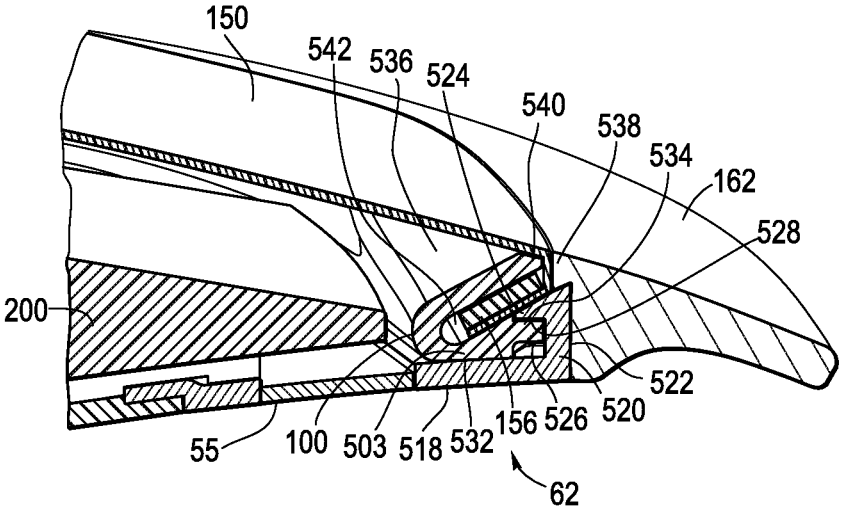
FIG. 22 is a partial, cross-sectional view of a front portion of a seat assembly.
Figure 23:
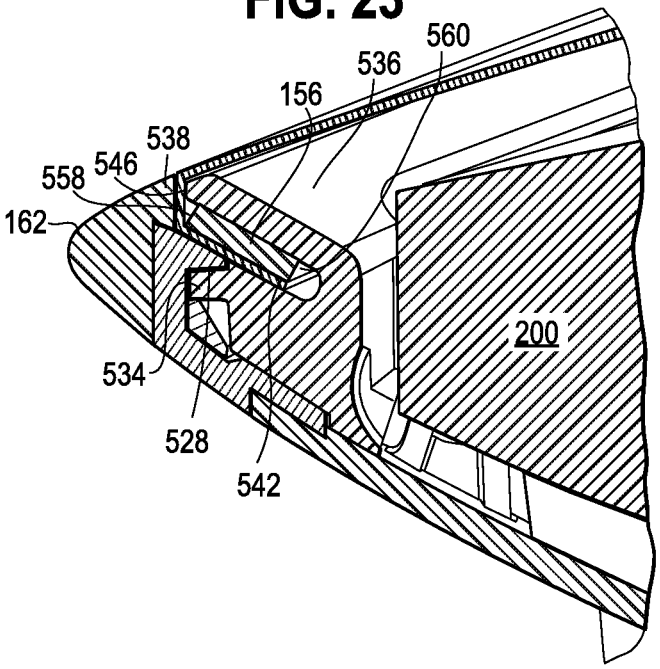
FIG. 23 is a partial, cross-sectional view of a side portion of a seat assembly.

In another embodiment, and referring to FIGS. 22 and 23, the support frame 62 includes a bottom wall 518 defining a body facing surface and a peripheral edge wall 520 having an outer surface 522. A lip 524, or catch, defined in one embodiment by a tab, extends laterally inwardly from the peripheral edge wall 520 and defines a channel 526 with the bottom wall. Along a side portion of the seat, shown in FIG. 23, the lip or catch has an engagement surface 528 that angles upwardly and inwardly from the peripheral edge wall while an upper surface of the wall is substantially horizontal. Along a front portion of the seat, shown in FIG. 44, the upper surface of the lip is angled downwardly and inwardly, while the engagement surface 528 is substantially horizontal.

A carrier frame 100 has a body portion 530 with a bottom surface 532 overlying and engaging the bottom wall and an insert portion 534 that is received in the channel 526 and engages the engagement surface 528. As shown in FIG. 44, the carrier frame has an upper surface 536 that is angled downwardly and inwardly, matching the top surface of the lip or catch, such that suspension material may deform against the angled surface. As shown in FIG. 23, the insert portion 534 is angled downwardly and outwardly so as to mate with the engagement surface. The orientation of the insert portion 534 facilitates installation as the insert portion may be more easily inserted into the channel when oriented at an angle such that the insert portion is underlying the lip 524. Tension applied by the textile material 150, configured as a suspension material in one embodiment, thereafter applies a moment to the carrier frame causing it to bear up against the bottom surface of the support frame and the engagement surface 528. A flexible edge member 162 is coupled to the outer surface 522 of the peripheral edge wall of the support frame, with a lip portion 538 overlying a top surface of the support frame. The flexible edge member 162 has an inner surface spaced apart from and facing inwardly toward the peripheral edge wall of the carrier frame, with the inner surface and the peripheral edge wall of the carrier frame defining a gap therebetween. A portion of the textile material is disposed in the gap, with the textile material covering the body facing surface of the carrier frame. The carrier frame has a peripheral edge 540 facing outwardly, and includes a groove 542 opening laterally outwardly therefrom. The peripheral edge of the textile material is secured to a stay 156, with the edge portion of the textile material and the stay disposed in the groove 542.

Suspension Material:

In one embodiment, the textile material is made of an elastomeric woven or knitted material, and may be configured as a suspension material having heat-shrinkable yarns and heat shrinkable elastomeric monofilaments, which shrink in response to the application of energy, for example heat, whether applied by radiation or convection. Various suitable suspension materials are disclosed in U.S. Pat. No. 7,851,390, entitled "Two-Dimensional Textile Material, Especially Textile Fabric, Having Shrink Properties and Products Manufacture Therefrom," the entire disclosure of which is hereby incorporated herein by reference. One commercially suitable heat-shrink suspension material is a SHRINX fabric available from Krall+Roth, Germany.

Figure 27:
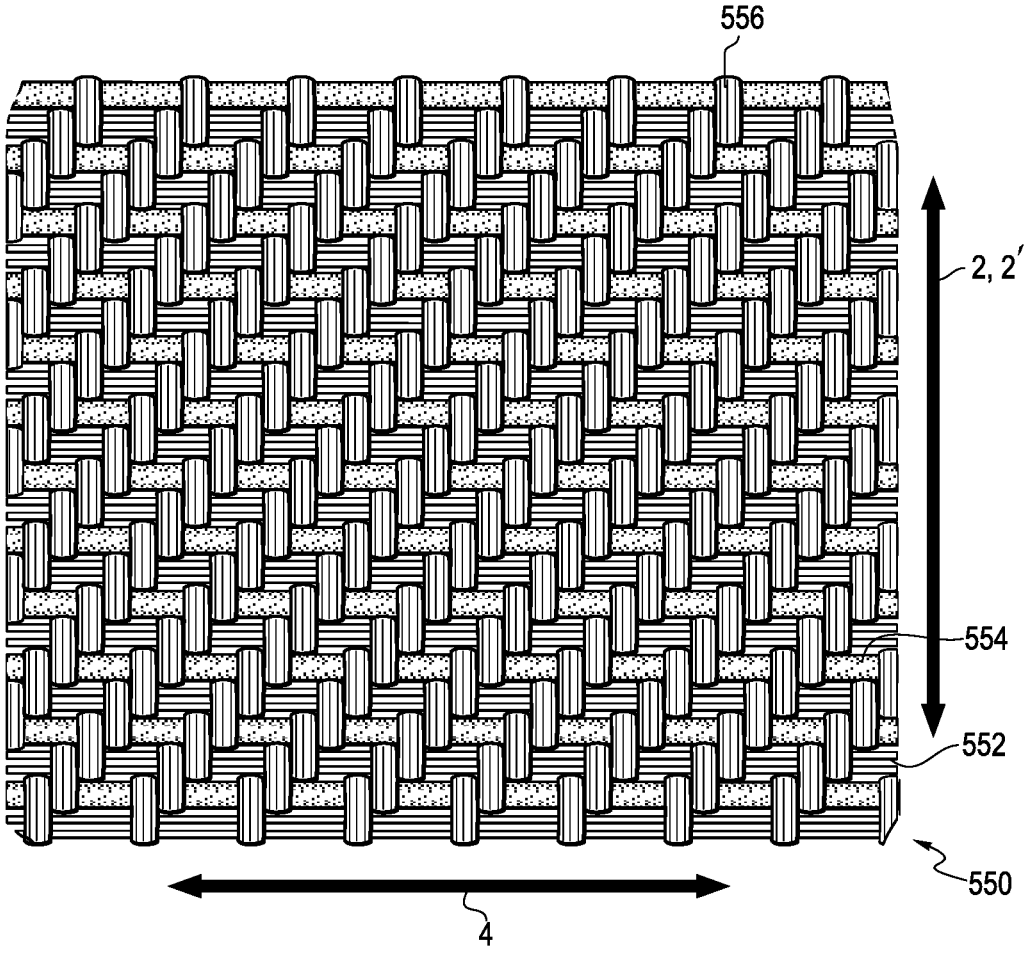
FIG. 27 is a partial, plan view of a textile material installed on the seat assembly and back support.
Figure 28A:
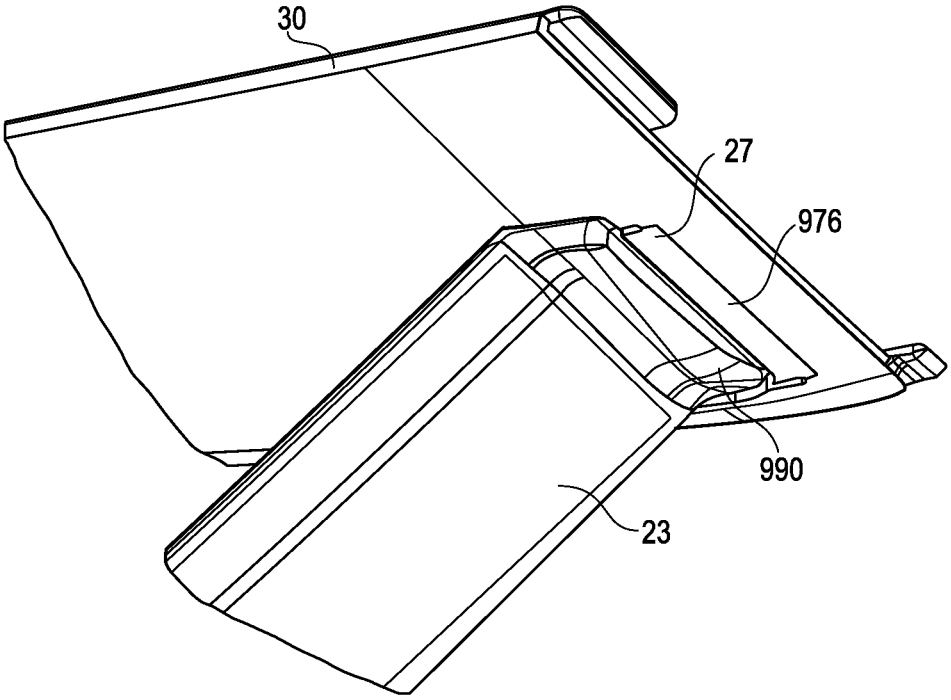
FIGS. 28A-D are a bottom, top, exploded and enlarged cross-sectional views showing the connection between a front link and the seat assembly.
Figure 28B:
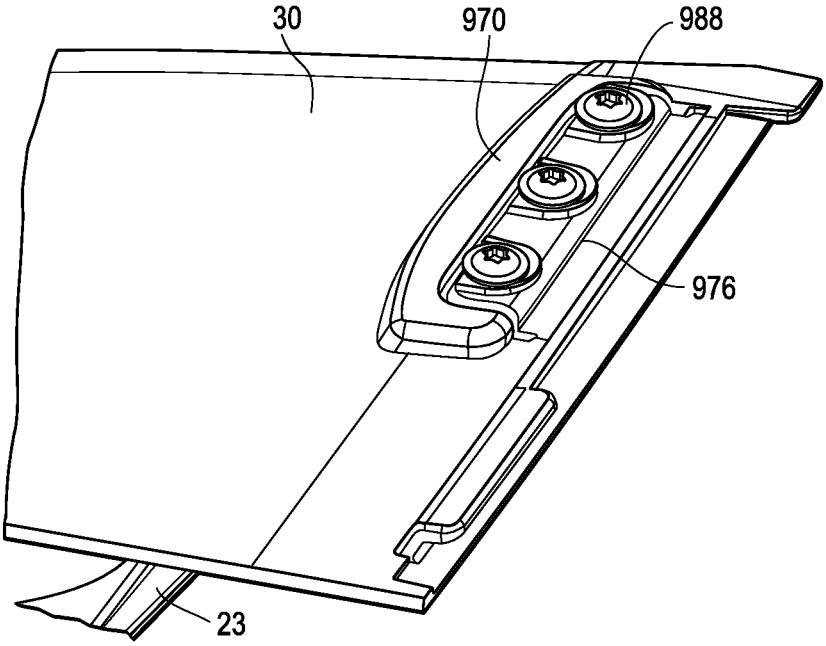
Figure 28C:
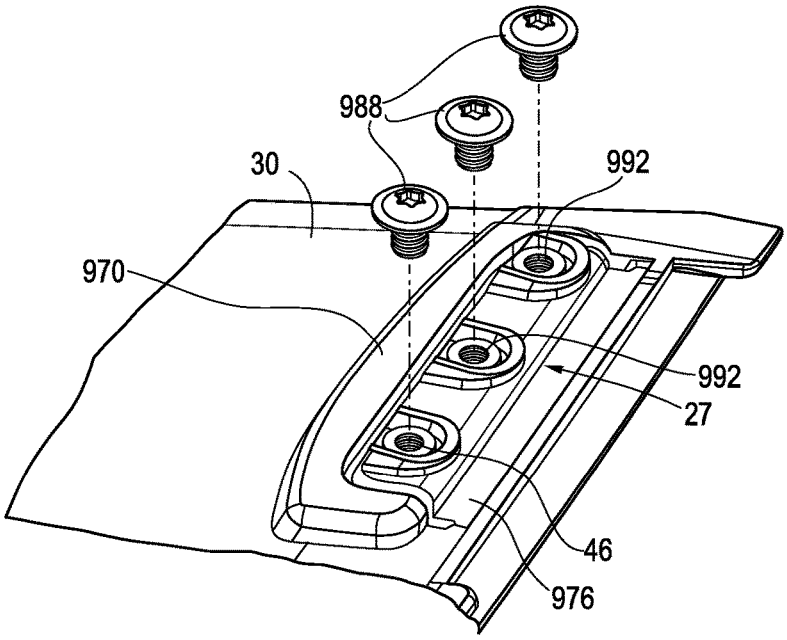
Figure 28D:
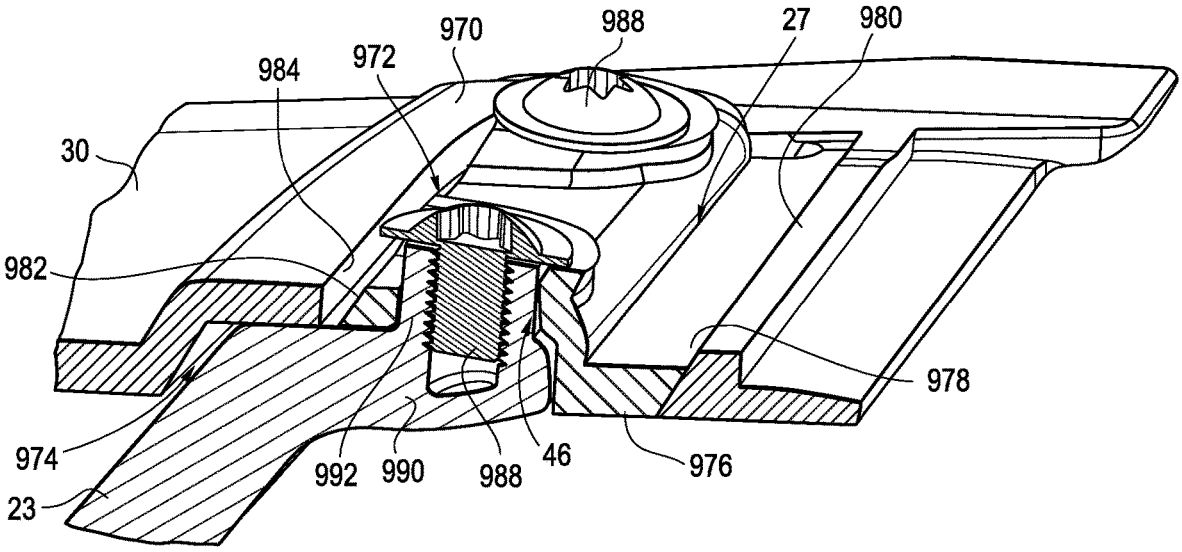

Referring to FIG. 27, in one embodiment, the suspension material is made from a fabric blank 500 having a plurality of heat shrinkable, elastic (elastomeric) threads 552, configured as monofilaments in one embodiment, running in a first, lateral direction 4, or warp direction, and a plurality of non-extensible threads 554, configured as yarns or monofilaments in various embodiments, running in the same lateral/warp direction 4. It should be understood that the heat shrinkable, elastic threads (e.g., monofilaments) and non-extensible threads (e.g., monofilaments) may also run in the longitudinal direction 2, 2'. In one embodiment, the heat shrinkable, elastic threads 552 and the plurality of non-extensible threads 554 alternate 1:1 or 2:1, or are disposed side-by-side as shown in FIG. 27, with various embodiments having a weave density of 4-10 elastic threads/cm, more preferably 7-9 elastic threads/cm, and a weave density of 8 elastic threads/cm in one embodiment. In other embodiments, the ratio of threads may be altered, with more or less elastomeric threads than non-extensible threads. In one embodiment, the elastic threads are about 0.40 mm in diameter, with the understanding that the elastic threads may be made thicker or thinner depending on the desired spring rate. It should be understood that more or less elastic threads may be used depending on the cross-sectional area of the thread. For example, the weave density may be defined by a total cross-sectional area of the combined elastic thread(s) per cm (measured longitudinally), including for example elastic thread(s) having a combined cross-sectional area (whether a single thread or a plurality of threads) between 0.502 $mm^2$/cm and 1.256 $mm^2$/cm in various embodiments, more preferably between 0.879 $mm^2$/cm and 1.130 $mm^2$/cm, and a combined cross-sectional area of 1.005 $mm^2$/cm in one embodiment.

A plurality of yarn strands 556 are interwoven with the elastomeric and non-extensible threads 552, 554 in the weft direction, or longitudinal direction 2, 2' in one embodiment. The non-extensible threads 554 and the yarn strands 556 do not shrink when exposed to heat or energy, and are not elastomeric. Rather, the yarn strands 556 provide shape control to the overall suspension material in a final configuration after heat shrinking. The yarn strands 556 may be made of various colors, e.g., blue, to provide color to the textile material. The overall color of the blank is thereby easily changed simply by introducing different yarns in the weft direction. In contrast, the elastomeric threads are preferably transparent or black.

Figure 26:
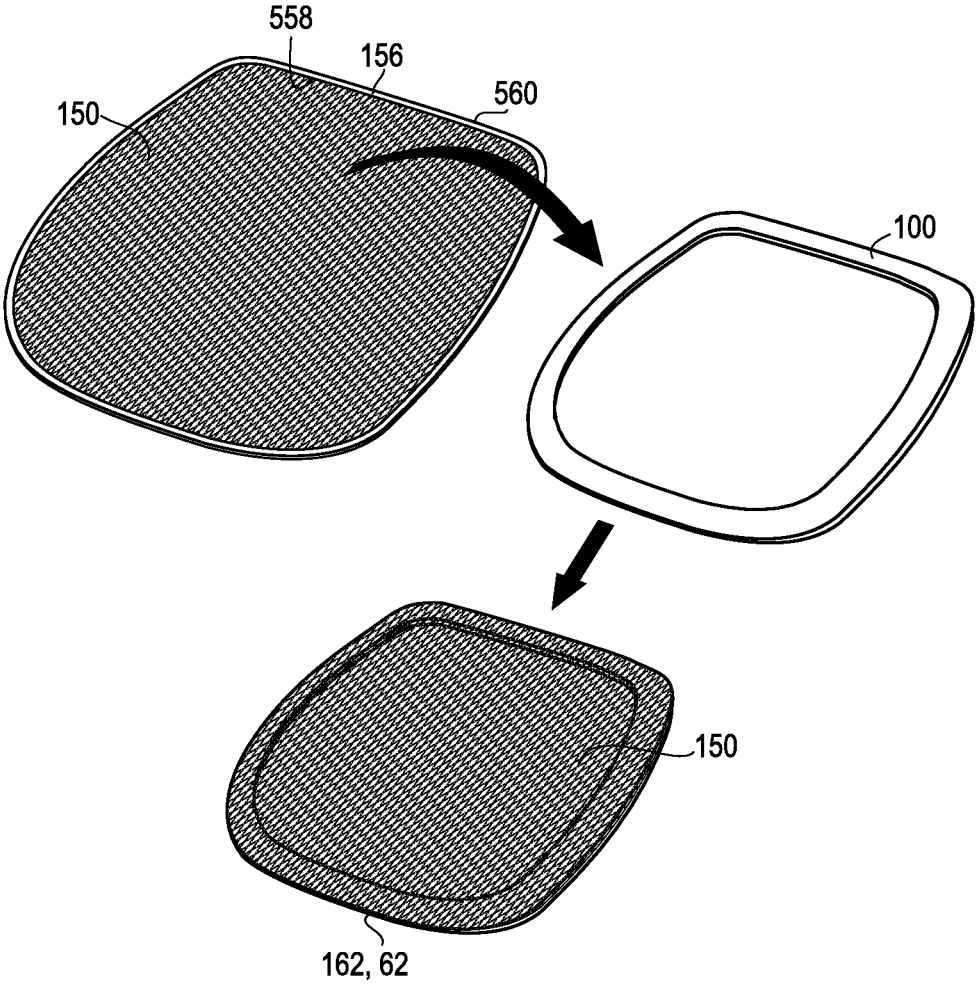
FIG. 26 is a flow diagram illustrating the assembly of the seat assembly.
Figure 29:
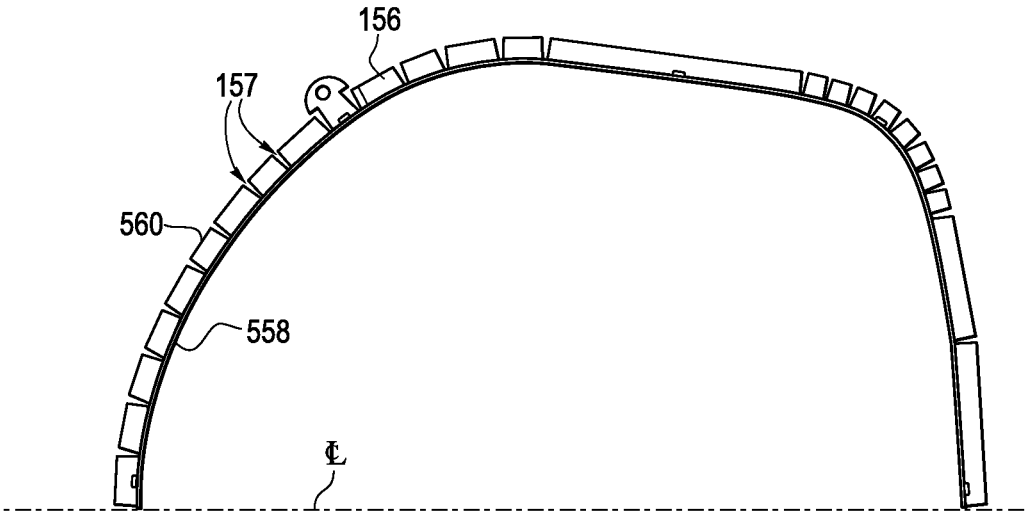
FIG. 29 is a partial view of one embodiment of a stay.

Referring to FIGS. 26 and 29, an annular stay 156 is secured to the fabric blank for example by sewing or with staples or other fastening systems, with the annular stay having first and second annular edges 558, 560. The annular stay is rotatable 180 degrees between a first configuration, wherein the first annular edge 558 is disposed radially inwardly from the second annular edge 560, and a second configuration, wherein the first annular edge 558 is disposed radially outwardly from the second annular edge 560 as shown in FIGS. 22 and 23. The first annular edge 558 on opposite sides of the stay define first and second dimensions therebetween in the first lateral direction 2, 2' when the stay is in the first and second configurations, wherein the first and second dimensions are substantially the same in one embodiment, meaning as the stay is rotated, the first annular edge remains stationary, albeit rotated 180 degrees. The stay 156 includes open notches 157 in the second annular edge, which close and allow for the stay to be rotated from the first to second configurations. The fabric blank 500 is initially configured with pockets of extra material at the corners to accommodate the rotation of the stays at those corners. After rotation, the stay 156 may be installed in the carrier frame 100, with the carrier frame and fabric then installed or coupled to the support frame 62, with the flexible edge 162 connected to the support frame 62 and disposed around the periphery of the textile material.

Energy, such as heat, may be applied to the fabric blank from an energy source, causing the heat shrinkable elastomeric threads 552 to shrink. In other embodiments, the textile material is wrapped around or covers a cushion or underlying substrate such as a plastic or metal web, which supports the user, with the edge of the textile material secured to the carrier frame as described herein. In those embodiments, the textile material 150 may be, but is not necessarily, put in tension around the cushion or across the opening 134.

The flexible edge member 162 is configured as a ring surrounding and coupled to the peripheral edge 92 of the support frame. It should be understood that the ring may be continuous, or that the flexible edge member may extend only partially around the periphery of the carrier frame 100. The flexible edge member 162 extends upwardly from the support frame 64 and has an inner peripheral surface 164, or face, facing inwardly toward, and spaced apart from, the peripheral edge surface 130 of the carrier frame so as to form a gap G, for example and without limitation having a width of between 0.50 to 1.00 mm that is communication with the groove 136, meaning the groove and gap form a continuous, but non-linear slotted opening or pathway that receives the textile material 150. In one embodiment, the inner surface 164 is substantially planar and has a vertical orientation and extends in the Z direction, although it should be understood that the edge surface may be curved, curvilinear, or non-planar, and/or may be oriented at angles other than a vertical plane. In one embodiment, the inner surface 164 has substantially the same shape as the peripheral edge surface 130 such that the gap G is maintained constant, regardless of whether either surface or the gap G is linear. In one embodiment, the gap G is the same or slightly larger than the thickness of the textile material, which may have a thickness of about 0.75 to 1.00 mm, while in other embodiments, there is no gap (i.e. G=0), or the gap G is less than the thickness of the textile material, with the surfaces 130, 164 abutting, and/or squeezing or slightly compressing the textile material 150 therebetween. The inner surface 164 faces and covers the groove 136 and textile material 150. In addition, the flexible edge member 162 further entraps the stay 156 and textile material 150, thereby further helping to ensure that the stay 156 does not become dislodged from the groove 136.

The flexible edge member 162 is made of a thermoplastic olefin or thermoplastic elastomer, and may be made of the same material as the membrane 53, such that the flexible edge member may be compressed, for example if impacted. The flexible edge member 162 has a greater resilience, or is more flexible and has a substantially lower modulus of elasticity less than the support frame 62, with a durometer in the shore D range, with one embodiment having a durometer of 80-90. The flexible edge member 162 protects the textile material 150 from inadvertent impact and wear and has an upper surface 166 substantially flush with, or slightly lower than, an upper surface 168 of the textile material 150, thereby preventing snags and providing a pleasing appearance. As mentioned, the flexible edge member 162 abuts, or is slightly spaced from, the portion of the textile material 150 disposed between the flexible edge member 162 and carrier frame 100. The flexible edge member has a groove 170, with the peripheral edge 92 of the support ring being disposed in the groove 170. In one embodiment, the flexible edge member 162 is over molded onto the peripheral edge 92 of the support frame 62, or support ring, and may be made of the same material as the membrane 53. In other embodiments, the flexible edge member may be secured to the support frame by friction, or with adhesives, mechanical fasteners, such as staples or screws, or combinations thereof. The geometry of the flexible edge member 162 further promotes the protective and elastic properties thereof. For example, the flexible edge member 162 may be tapered from a first thickness T1 along the inner surface 164 to a second thickness T2 at an outermost peripheral edge thereof, with the thickness being measured parallel to the inner surface 164, or in substantially the Z direction. In one embodiment, the nose tapers to a point where T2=0. In one embodiment, the flexible edge member 162 in cross-section has a rounded nose shape. The flexible edge member 162 may be compressed in response to a load applied in the X and/or Y directions, or may deflect in response to a load applied in the Z direction as shown in FIG. 7B.

Figure 20:
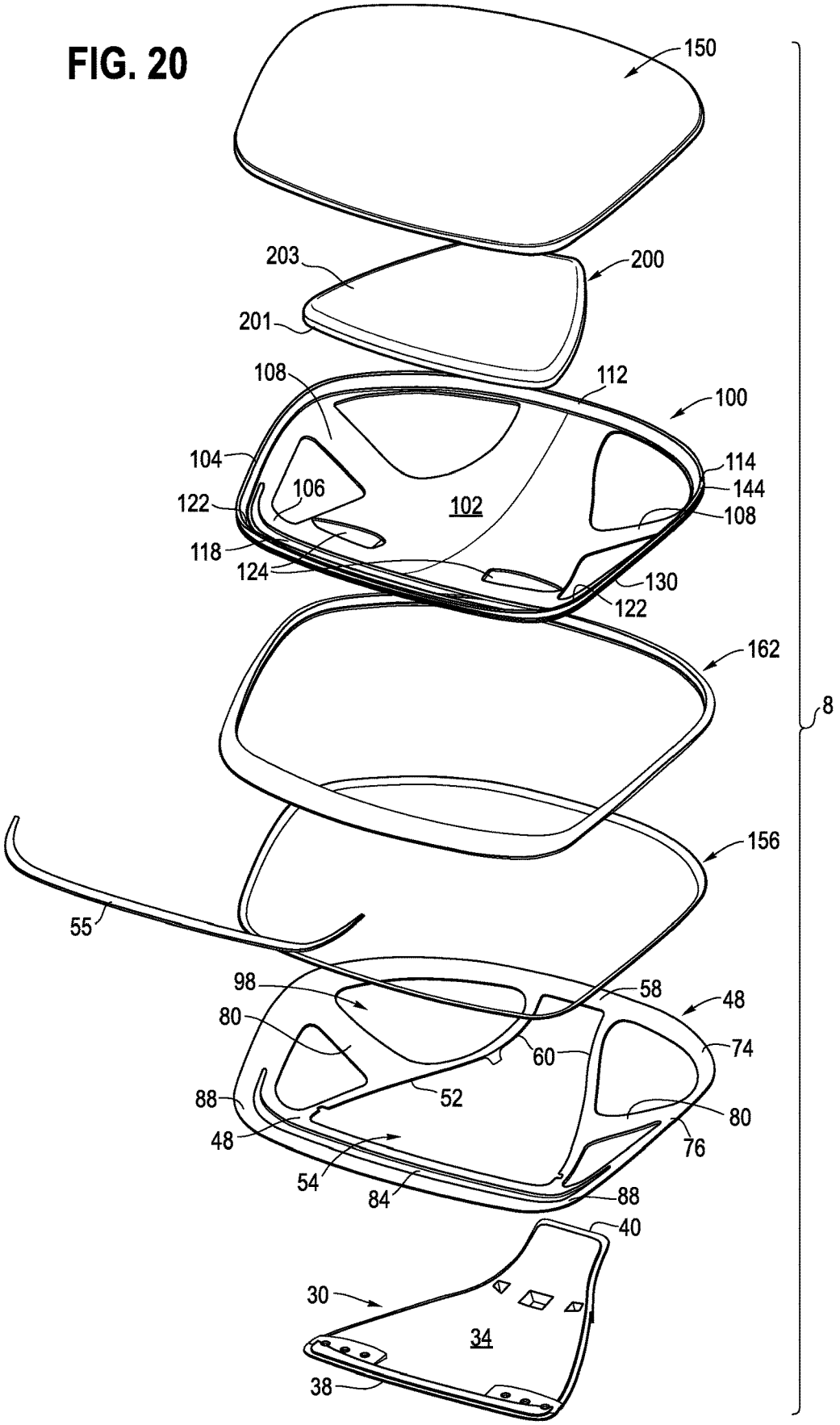
FIG. 20 is an exploded view of a seat assembly.

In one embodiment, an auxiliary support member 200, shown as a cushion, is disposed between the upper surface 126 of the carrier frame 100 and a bottom surface 190 of the textile material 150, configured as a suspension material, or the space defined therebetween. An upper surface 202 of the auxiliary support member 200 is spaced apart from the bottom surface 190 of the suspension material such that a gap G2 or space is defined therebetween when the suspension material is in an unloaded configuration (i.e., without a user disposed on the suspension material). In various embodiments, the gap G2 may be maintained as a constant, with the cushion having a contoured upper surface 202 that matches the contour of the bottom surface 190 of the suspension material. In various embodiments, the gap G2 is greater than 0 and less than 5 mm, and in one embodiment is 3 mm, such that the suspension material contacts the auxiliary support member 200 as soon as the user engages, or sits on, the suspension material. The auxiliary support member 200 may have a generally trapezoidal shape in plan view that matches the shape of the central portion 102 of the carrier frame or the support platform 30. The auxiliary support member 200 extends forwardly to cover the opening 118 and support the thighs of the user. The auxiliary support member may be made of foam. The auxiliary support member 200 may be secured to the support platform 30 and/or carrier frame 100 with fasteners, including mechanical fasteners such as screws or adhesive. In one embodiment, the auxiliary support member 200 has a bottom substrate 201, for example a plastic or wood sheet, that may be engaged with fasteners and which is connected to, or embedded in, an upper foam cushion 203 as shown in FIG. 20.

Figure 18:
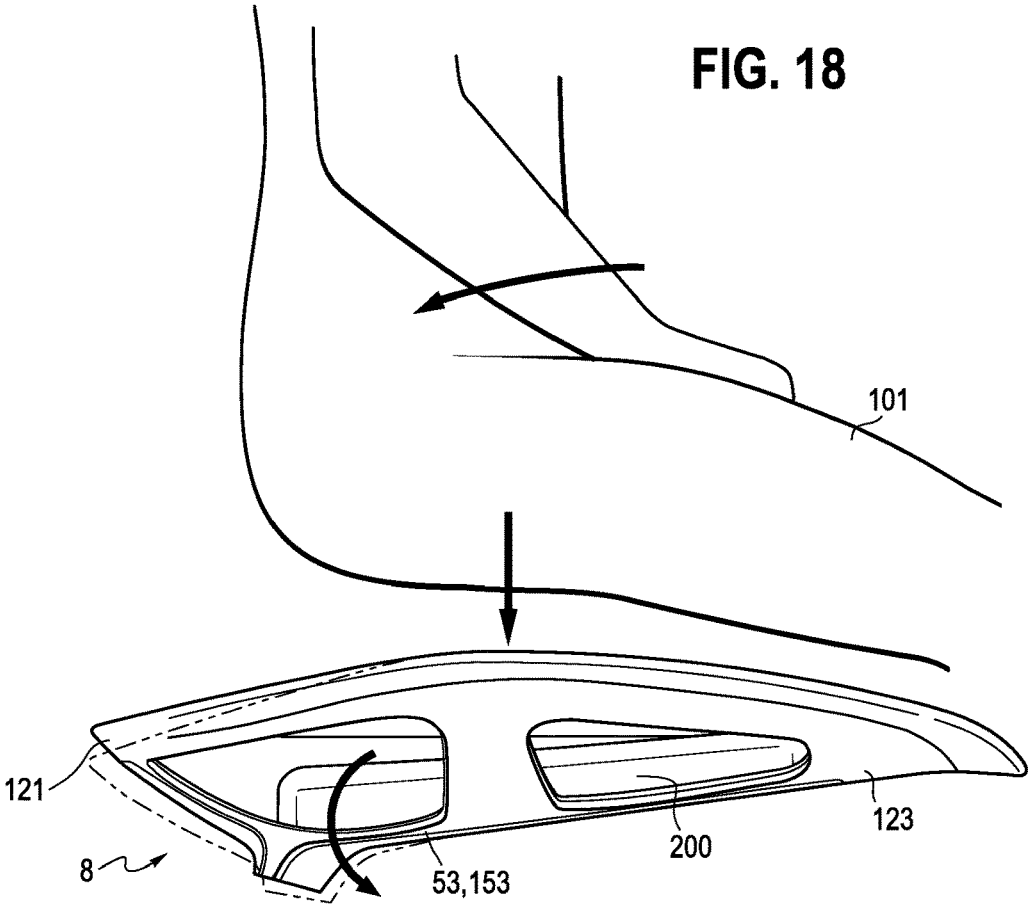
FIG. 18 is a schematic side view illustrating flexing of the seat assembly during recline.
Figure 19:
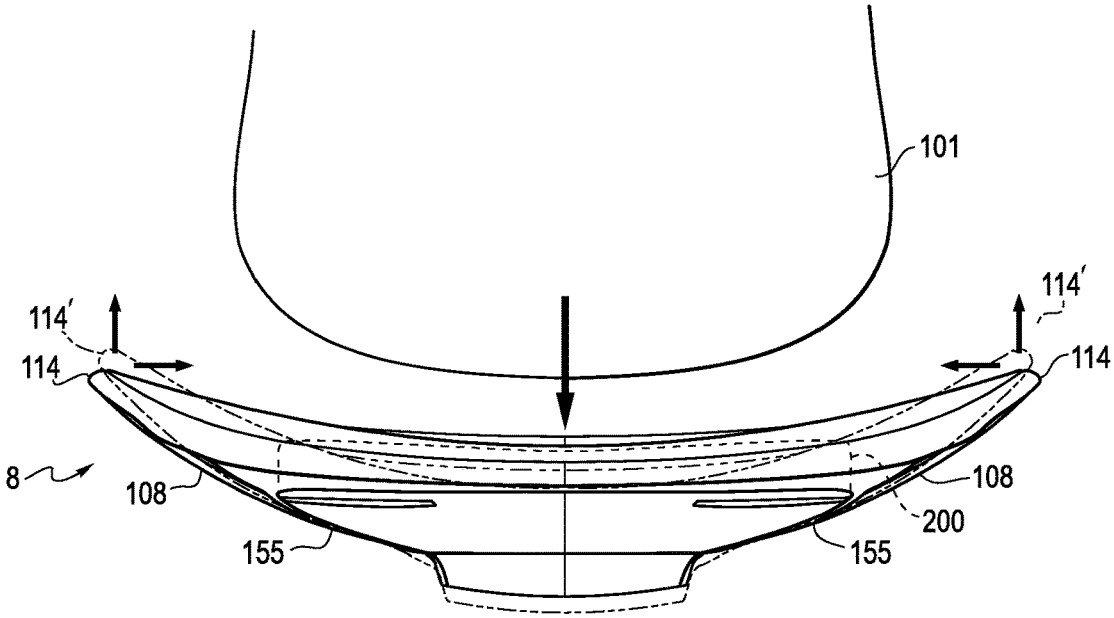
FIG. 19 is a schematic front view illustrating flexing of the seat assembly during recline.
Figure 30:
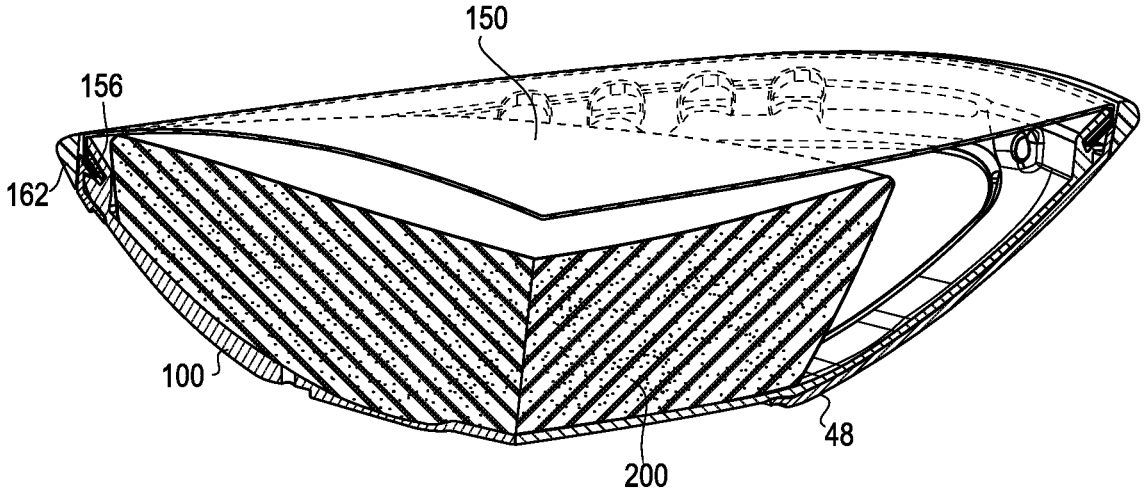
FIG. 30 is a partial cut-away view of a seat assembly.

In operation, and referring to FIGS. 18, 19, and 30, as a user sits on the suspension material 150, the load applied to the suspension material 150 causes it to deflect downwardly toward the auxiliary support member 200. If the load is such that the suspension material deflects across the distance G2 and comes into contact with the auxiliary support member 200, the auxiliary support member 200 thereafter may absorb the additional loading and support the user.

It should be understood that in other embodiments, the auxiliary support member 200 abuts and supports the textile material in an unloaded condition. For example, the textile material may simply cover a cushion, which fills the space of the cavity 132 of the carrier frame, with the textile material forming an upholstery cover over the top of the cushion.

In one embodiment, a method of manufacturing or assembling a body support member 10 includes positioning and securing the auxiliary support member 200 on top of the carrier frame 100. The method further includes disposing the peripheral edge portion 154, 252 of the textile material 150, 234 into the peripheral groove 136, 244 formed in the peripheral edge surface 130, 246 of the frame, with the stay 156, 250 engaging one surface of the groove. As the stay 156, 250 is rolled over for insertion into the groove, the suspension material covers the portion of the peripheral edge surface 130, 246 between the groove and the upper (or front) surface 126 (i.e., body-facing first surface of the frame). The carrier frame 100, 242 is then connected to the support frame 62, 236, which has a flexible edge member 162, 240 secured thereto for example by way of support ring 48. Conversely, the flexible edge member 162 may first be connected to the carrier frame 100, for example by way of the support ring 48, with those components thereafter being coupled to the support platform 30. In one embodiment, the flexible edge member 162, 240 is secured to the support frame 62, or support ring 48, by over molding the flexible edge member 162 onto the peripheral edge 92 of the support frame/support ring. The flexible edge member may be secured in other ways, including with adhesive or mechanical fasteners.

Energy, for example thermal energy or heat applied by radiation or convection, may be applied to the suspension material 150, 234, causing the suspension material to shrink and create tension therein. The energy may be applied to the suspension material either before or after the carrier frame 100, 242 is secured to the support frame 62, 212. As the suspension material shrinks, the suspension material is put in tension across the opening 134 and the stays 250, 156 are anchored in the grooves 136, 244.

Backrest Assembly:

Referring to FIGS. 1-6 and 7B, the backrest assembly 6 includes a back frame 210 and a back support 212, otherwise referred to as a support frame. The back frame is relative rigid, meaning it does not substantially flex/bend or otherwise elastically deform during recline. The back frame 210 has a lower portion 214 that is connected to the rear portion of the tilt control assembly 18. The lower portion 214, or lower support arm, extends generally horizontally in the longitudinal direction 2' along a central axis of the seating structure. The back frame 210 is pivotable rearwardly relative to the base 12 during recline.

A transition portion 216, which is a curved and defines a rearwardly facing convex bow shape in one embodiment, extends rearwardly and upwardly from the lower portion 214. A pair of laterally spaced uprights 218 extend upwardly from the transition portion 216. The back frame 210 further includes an upper cross member 220 extending between and connecting upper ends of the uprights 218, with the cross member 220, upright 218 and lower portion 214 defining a central opening. The back support 212, otherwise referred to as a support frame, is flexible, and includes flex regions 225, 233 allowing it to bend and deflect in response to the user reclining in the body support structure. The back support, or support frame 212, includes a pair of laterally spaced uprights 222, each having a forwardly facing convex bow shaped portion 223 at a first location proximate a lumbar region of the back support, with each bow shaped portion including and defining a flex region.

A bottom portion 224 extends between and connects the uprights. The back support 212 further includes a lower portion or support arm 226 that extends forwardly from the bottom portion, with the support arm or lower portion coupled to the control assembly. The uprights 222 of the back support are coupled to the uprights 218 of the back frame with connectors 228. The back support 212 is pivotable with the back frame 210. In one embodiment, the uprights 218, 222 may be pivotally connected with a mechanical pivot joint, including for example the pivot structure disclosed in U.S. Pat. No. 9,826,839, the entire disclosure of which is hereby incorporated herein by reference.

The back support 212 includes an upper member 230 extending between and connected to upper ends of the pair of second uprights 222, and the bottom portion 224 extends between and is connected to the lower ends of the pair of second uprights. The upper member 230, uprights 222 and the bottom portion 224 define a central opening 232. A suspension material 234 is stretched across the central opening 232 and is secured to the back support 212 in a similar fashion as the seat.

Specifically, the upper member 230, the bottom portion 224 and the pair of second uprights 222 define a support frame 236 having a peripheral edge 238 as shown in FIG. 7B. A flexible edge member 240 is secured to the peripheral edge of the upper member 230 and uprights 222, or along a face of the bottom portion 224. A carrier frame 242 is coupled to the support frame 236 and includes a peripheral groove 244 facing outwardly from a peripheral edge surface or face 246, oriented horizontally between the front and rear surfaces of the carrier frame, which is spaced apart from an inner surface or inwardly facing face 248 of the flexible edge member 240 and defines a space or gap G therebetween as disclosed above with respect to the seat assembly. The groove 244 opens outwardly from the carrier frame 242 along the peripheral edge 246 thereof. The suspension material 234 includes at least one stay 250, configured as a ring in one embodiment, secured along a peripheral edge portion 252 of the suspension member, wherein the at least one stay is disposed in the groove 244. The stay 250 may be held by friction alone, without any auxiliary support material such as adhesive. In one embodiment, the stay directly 250 engages one surface, e.g., a front surface, of the groove 244, while the fabric engages the rear surface. In this way, as with the seat, the stay engages the surface of the groove 244 closest to the surface of the carrier frame covered by the fabric. In one embodiment, the stay 250 is formed as a continuous ring having a fixed length, with the stay 250 being relatively inelastic and resistant to elongation along a length thereof, but which may be flexible and bendable.

Figure 24:
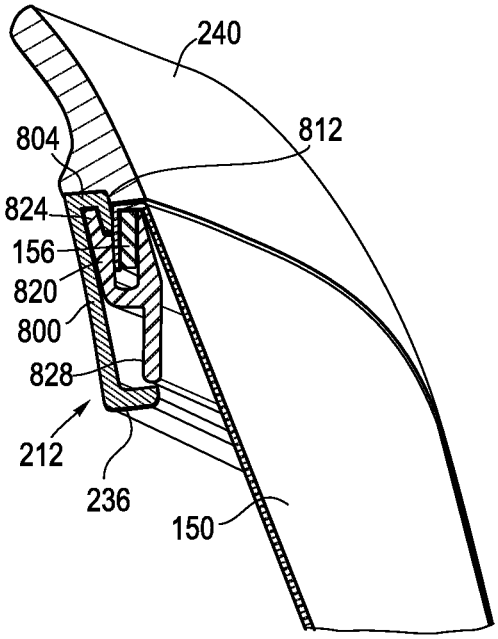
FIG. 24 is a partial, cross-sectional view of a top portion of a back support.
Figure 25:
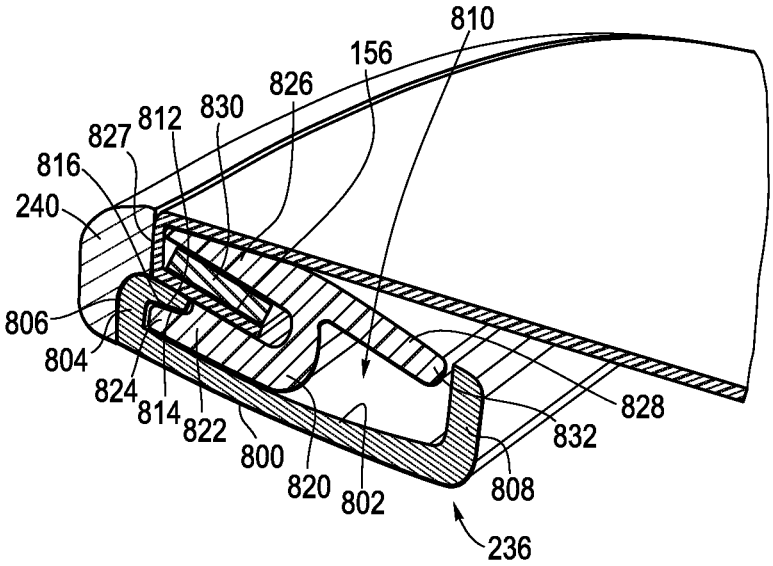
FIG. 25 is a partial, cross-sectional view of a side portion of a back support.

In another embodiment, and referring to FIGS. 24 and 25, the support frame 236 includes a rear wall 800 defining a body facing surface 802, an outer peripheral edge wall 804 having an outer surface 806 and an inner peripheral edge 808 wall, with the walls 804, 808 defining a forwardly facing channel 810. A lip 812, or catch, extends laterally inwardly from the outer peripheral edge wall and defines a channel 816 with the rear wall 800, with a rear surface of the lip defining an engagement surface 814. A carrier frame 820 has a body with a rear flange 822 defining a rear surface overlying and engaging the rear wall and an insert portion 824, defined by a plurality of tabs 825 spaced apart around the periphery of the carrier frame 820 in one embodiment. The insert portion 824 is received in the channel 816 and engages the engagement surface 814. The carrier frame 820 further includes upper and lower pairs of lugs 827 that are aligned with lug 829 on the support frame 236, with fasteners 831 securing the lugs 827, 829 to further connect the support frame 236 and carrier frame 820. The carrier frame 820 includes a second flange 826 that forms an outwardly facing groove 830 with the flange 822 and defines an outer peripheral edge wall 827. The flange 826 extends across the channel 810 with an edge 832 positioned adjacent the inner peripheral edge wall 808 and closing the channel. Tension applied by the textile material, configured as a suspension material 150 in one embodiment, thereafter applies a moment to the carrier frame 820 causing it to bear up against the bottom surface of the support frame and the engagement surface. A flexible edge member 240 is coupled to the outer surface of the peripheral edge wall 804 of the support frame, with a lip portion overlying a top surface of the support frame. The flexible edge member 240 has an inner surface spaced apart from and facing inwardly toward the peripheral edge wall of the carrier frame, with the inner surface and the peripheral edge wall 827 of the carrier frame defining a gap therebetween. A portion of the textile material is disposed in the gap, with the textile material covering the peripheral edge wall 827 and body facing surface of the carrier frame. The peripheral edge of the textile material is secured to a stay 156, with the edge portion of the textile material and the stay disposed in the groove 830. The carrier frame 242 may be secured to the support frame with the overlapping tabs 815, 825 and fasteners 831, including mechanical fasteners and/or adhesive.

Operation:

In operation, and referring to FIGS. 18, 19, 21 and 26, a user 101 may sit in the body support structure 10. Depending on the weight of the user, and the amount of deflection of the suspension material 150, and the deflection of the side portions of the support/carrier frames coupled to the suspension material, the suspension material may engage the upper surface 202 of the auxiliary support member 200, or cushion 203, which thereafter assists in absorbing the load of the user. In essence, the side portions are inwardly deflectable a first amount from a first unloaded configuration to a first loaded configuration in response to a load applied to the elastic material, and define in essence a first spring to absorb the load of the user. The elastic textile material, or suspension material 150, coupled to the side portions 114 across the opening is downwardly deflectable a second amount from a second unloaded configuration to a second loaded configuration in response to the load applied thereto, and defines a second spring to absorb the load of the user. Stated another way, the deflection of the frame, or side portions, and the deflection of the suspension material act in combination to provide a first amount of support to the user. The cushion disposed beneath the textile material engages and provides auxiliary support to the elastic material when the first and second amounts of deflection, or first amount of support, result in the elastic material contacting the cushion, which defines a third spring to absorb the load of the user. The upper surface of the cushion 203 is spaced apart from the textile material when the side portions 114 are in the first unloaded configuration and the elastic suspension material 150 is in the second unloaded configuration. In this way, the flexible support/carrier frame, elastic suspension material and cushion provide first, second and third amounts of resilient support to a user engaging and supported by the textile material, with the suspension material and flexible frame working in combination. It should be understood that the elastic suspension material 150 is downwardly deflectable a first amount in response to the deflection of the at least one side portion 114, or both side portions depending on where the load is applied.

The resilience and deflection of the side portions 114 is primarily a function of the deflection of the at least one connector 80, 108 extending between the central portion 102 and support platform 30 and the side portions 114. The connectors 80, 108 extend upwardly and outwardly from the central portion, and curved with an upwardly facing concave surface such that is rigid and resists outward/downward deflection/deformation. As noted above, the connectors 80, 108 includes a pair of opposite side connectors that are inwardly deflectable from the first unloaded configuration to the first loaded configuration in response to the load applied to the elastic material.

The user 101 may recline, with the tilt control assembly 18 providing for the seat and/or backrest assemblies 8, 6 to move rearwardly, whether by pivoting, rotation, translation or a combination thereof, for example by way of a four-bar mechanism including links 8, 23, 25 and 33.

Referring to FIGS. 18, 19 and 21, as the seat assembly 8 tilts or reclines rearwardly, the support platform 30 and the carrier frame 100 flex or bend about the flex regions 53, 153, such that the rear portion 121 of the seat assembly, and rear portion of the support platform, rotates or deflects downwardly relative to the front portion 123 of the seat assembly, and front portion of the support platform, about the flex region. At the same time, and due to the geometry of the seat assembly, including the configuration of the outer ring 104, the geometry of the connectors 108, the concavity of the carrier frame 100, and the configuration of the openings 109, 119, the intermediate connectors 108 flex or bend upwardly about flex regions 155, such that the side member 114 of the outer ring 104 move upwardly relative to the support platform and inwardly toward each other to a new configuration or shape of the side member 114', with the textile material 150 assuming a more concavely configured textile material 150' that slightly hammocks and hugs the user. As the connectors 108 and outer ring 104 deflect, the overall length of the outer ring 104 is maintained, and is not increased. It should be understood that referring to the side members 114 moving upwardly is relative to the support platform 30, which in part may be moving downwardly, such that the overall or absolute movement of the side members relative to ground is negligible. The support ring 48 is sufficiently flexible and compliant that the support ring 48 does not interfere with the flexing of the carrier frame 100, but rather provides a decorative and tactile skin covering a bottom surface of the carrier frame. If needed, the support ring 48 may also be provided with flex regions to allow such flexing. Due to the geometry of the seat assembly, including the configuration of the outer ring 104, the geometry (e.g., upwardly concavity) of the curved connectors 108, the concavity of the carrier frame 100, and the configuration of the openings 109, 119, the side members 114 and connectors 108 are relatively rigid, and resist/avoid a downward deformation, in response to downward load applied along the sides of the seat at the perimeter of the chair.

Due to the orientation of the front and rear links, and relative positioning of the flex regions 27, 53, which are disposed upwardly and forwardly of the flex regions 29, 31 respectively, the four-bar linkage provides a weight activated system, meaning the weight of the user is taken into account when reclining since the increase in potential energy is offset by the kinetic energy required to recline. In this way, the four-bar mechanism will provide more resistance to a heavier user and automatically counterbalance the user. As noted previously, the amount of recline may be limited by the recline limiter, while energy may supplied to boost the resistance to recline and return the body support assembly to the upright, nominal position.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A seat assembly comprising:

a lower support platform extending in a longitudinal direction and comprising opposite side edges and a laterally extending first flex region extending between the opposite side edges, wherein the first flex region bifurcates the lower support platform into a front portion and a rear portion extending rearwardly from the first flex region and the front portion, wherein the first flex region is bendable such that the rear portion is downwardly deflectable relative to the front portion; and an upper shell comprising opposite side members connected to the support platform with a pair of connectors, each of the connectors comprising a second flex region, wherein the second flex regions are bendable such that the opposite side members are upwardly and/or inwardly moveable relative to the lower support platform as the rear portion is downwardly deflectable relative to the front portion.

2. The seat assembly of claim 1 wherein the upper shell defines a concave cavity and comprises an outer ring defining a central opening, wherein the side members define at least in part the outer ring.

3. The seat assembly of claim 2 wherein the outer ring maintains a fixed length as the opposite side members are upwardly and/or inwardly moveable relative to the lower support platform.

4. The seat assembly of claim 2 further comprising a suspension material secured to the outer ring of the upper shell across the central opening, wherein the suspension material covers the concave cavity.

5. A seat assembly comprising:

a lower support platform extending in a longitudinal direction and comprising opposite side edges and a laterally extending first flex region extending between the opposite side edges, wherein the first flex region bifurcates the lower support platform into a front portion and a rear portion, wherein the first flex region is bendable such that the rear portion is downwardly deflectable relative to the front portion; and an upper shell comprising opposite side members connected to the support platform with a pair of connectors, each of the connectors comprising a second flex region, wherein the second flex regions are bendable such that the opposite side members are upwardly and/or inwardly moveable relative to the lower support platform as the rear portion is downwardly deflectable relative to the front portion, wherein the upper shell comprises a groove extending around at least a portion of the outer ring, wherein a peripheral edge of the suspension material is disposed in the groove.

6. The seat assembly of claim 5 further comprising at least one stay coupled to the peripheral edge of the suspension material, wherein the at least one stay is disposed in the groove.

7. The seat assembly of claim 6 further comprising a support ring surrounding the lower support platform and extending radially outwardly therefrom, wherein the support ring defines a second peripheral edge, and a flexible edge member coupled to the second peripheral edge of the support ring, wherein the flexible edge member is disposed along a peripheral edge of the outer ring and covers the groove.

8. The seat assembly of claim 4 further comprising a cushion disposed between an upper surface of the upper shell and a bottom surface of the suspension material.

9. The seat assembly of claim 8 wherein an upper surface of the cushion is spaced apart from the bottom surface of the suspension material.

10. The seat assembly of claim 1 wherein the lower support platform has a generally trapezoidal shape with a rear edge being shorter than a front edge and the opposite side edges joining the front and rear edges.

11. The seat assembly of claim 1 wherein the upper shell comprises a central portion overlying the lower support platform, and an outer ring defining in part the opposite side members, wherein the outer ring and central portion of the upper shell are coupled with the pair of connectors.

12. The seat assembly of claim 1 wherein the second flex regions are bendable such that the opposite side members are moveable inwardly toward each other as the rear portion is downwardly deflectable relative to the front portion.

13. A body support member comprising:

a carrier frame comprising a central portion and a peripheral ring connected to the central portion with a plurality of connectors each comprising a flex region, the peripheral ring defining a central opening;

an elastic textile material coupled to the peripheral ring across the central opening; and a cushion disposed between the central portion and the elastic textile material;

wherein at least one of the plurality of connectors is inwardly deflectable a first amount from an unloaded configuration to a loaded configuration in response to a load applied to the elastic textile material, wherein the elastic textile material is downwardly deflectable a first amount corresponding to the first amount of inward deflection of the at least one of the plurality of connectors, and wherein the elastic textile material is downwardly deflectable a second amount in response to the load applied thereto separate and independent from the first amount of downward deflection of the elastic textile material, and wherein the cushion engages and provides auxiliary support to the elastic textile material when the first and second amounts of downward deflection of the elastic textile material result in the elastic textile material being supported by the cushion.

14. The body support member of claim 13, wherein the cushion comprises an upper surface spaced apart from the elastic textile material when the at least one of the plurality of connectors is in the unloaded configuration.

15. The body support member of claim 13, wherein the at least one of the plurality of connectors extends upwardly and outwardly from the central portion.

16. The body support member of claim 15, wherein the at least one of the plurality of connectors is curved and comprises an upwardly facing concave surface.

17. The body support member of claim 13, wherein the plurality of connectors comprises at least one first side connector extending laterally from a first side of the central portion and at least one second side connector extending laterally from a second side of the central portion opposite the first side, wherein each of the first and second side connectors is inwardly deflectable from the unloaded configuration to the loaded configuration in response to the load applied to the elastic textile material.

18. A body support member comprising:

a carrier frame comprising opposite side portions defining an opening therebetween;

an elastic textile material coupled to the side portions across the opening; and a cushion disposed beneath the elastic textile material;

wherein at least one of the side portions is inwardly deflectable a first amount from an unloaded configuration to a loaded configuration in response to a load applied to the elastic textile material, wherein the elastic textile material is downwardly deflectable a first amount corresponding to the first amount of inward deflection of the at least one of the side portions, and wherein the elastic textile material is downwardly deflectable a second amount in response to the load applied thereto separate and independent from the first amount of downward deflection of the elastic textile material, and wherein the cushion engages and provides auxiliary support to the elastic textile material when the first and second amounts of downward deflection of the elastic textile material result in the elastic textile material being supported by the cushion.

19. The body support member of claim 18, wherein the cushion comprises an upper surface spaced apart from the elastic textile material when the at least one of the side portions is in the unloaded configuration.

20. A body support member comprising:

a flexible carrier frame deformable from an unloaded configuration to loaded configuration;

an elastic textile material coupled to the carrier frame, wherein the elastic textile material is downwardly deflectable a first amount in response to the deformation of the flexible carrier frame from the unloaded configuration to the loaded configuration, and wherein the elastic textile material is downwardly deflectable a second amount separate and independent of the first amount in response to a load applied by a user engaging and supported by the elastic textile material; and a cushion disposed beneath the elastic textile material;

wherein the flexible carrier frame, elastic textile material and cushion are configured to provide first, second and third amounts of resilient support to the user engaging and supported by the elastic textile material.

21. The body support member of claim 20, wherein the cushion comprises an upper surface spaced apart from the elastic textile material when the carrier frame is in the unloaded configuration.

* * * * *